US007599758B2

(12) United States Patent
Reindle et al.

(10) Patent No.: US 7,599,758 B2
(45) Date of Patent: Oct. 6, 2009

(54) SENSORS AND ASSOCIATED METHODS FOR CONTROLLING A VACUUM CLEANER

(75) Inventors: Mark E. Reindle, Sagamore Hills, OH (US); Norman Siegel, Mentor, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 631 days.

(21) Appl. No.: 11/294,591

(22) Filed: Dec. 5, 2005

(65) Prior Publication Data

US 2006/0085095 A1 Apr. 20, 2006

Related U.S. Application Data

(63) Continuation-in-part of application No. 10/665,709, filed on Sep. 19, 2003, now Pat. No. 7,237,298.

(51) Int. Cl.
*G05B 19/00* (2006.01)

(52) U.S. Cl. ..... 700/258; 700/245; 700/246; 700/247; 700/248; 700/259; 15/3; 15/4; 15/50.1; 15/52.1; 15/319; 701/23; 701/24; 701/25; 701/26; 701/200; 318/568.1; 318/568.12; 318/581; 318/587; 340/573.1; 340/686.1; 340/988; 901/1; 901/46; 901/47

(58) Field of Classification Search ..... 700/245, 700/258, 246, 247, 248, 250, 256, 259, 261, 700/4, 50.1, 52.1, 319, 320, 340.1, 340.3, 700/347, 349, 353, 377, 383; 318/568.1, 318/568.12, 568.17, 587; 15/49.1, 3, 4, 50.1, 15/52.1, 319, 320, 340.1, 340.3, 347, 349, 15/353, 377, 383; 701/23, 25, 2, 24, 26, 701/50, 200, 213, 300, 301; 901/47, 1, 46
See application file for complete search history.

(56) References Cited

U.S. PATENT DOCUMENTS 4,558,215 A 12/1985 Kaneko et al.

(Continued)

FOREIGN PATENT DOCUMENTS

| | | |
|---|---|---|
| EP | 1149332 B1 | 8/2003 |
| WO | WO 00/38027 | 6/2000 |
| WO | WO 2005/077240 | 8/2005 |

OTHER PUBLICATIONS

Home Appliances , Vacuum Cleaners, SG2039/D, Rev 0, Apr. 2003, Motorola, Inc. (6 pages).
The New York Times, www.nytimes.com, "It Mulches, Too? Robotic Mowers Gain in Appeal" by John R. Quain, Jul. 31, 2003 (3 pages).

(Continued)

*Primary Examiner*—Khoi Tran
*Assistant Examiner*—McDieunel Marc
(74) *Attorney, Agent, or Firm*—Fay Sharpe LLP

(57) ABSTRACT

A vacuum cleaner includes a housing, a height adjust mechanism disposed on the housing and a height adjust motor, disposed within said housing that controls a height of the height adjust mechanism. A position element is mounted to said housing. A sensor processor, mounted to said housing, is in communication with the position element to provide a signal that relates to a position of the height adjust mechanism based at least in part upon data received from the position element. A controller processor, mounted to said housing, is in communication with the sensor processor for selectively controlling a height of the height adjust mechanism relative to a subjacent surface on which the vacuum cleaner is positioned. A height adjust mechanism height motor controller is in communication with the controller processor, for driving the height adjust motor to locate the height adjust mechanism in an appropriate position relative to the subjacent surface.

17 Claims, 25 Drawing Sheets

U.S. PATENT DOCUMENTS

| | | | | |
|---|---|---|---|---|
| 4,706,327 | A * | 11/1987 | Getz et al. | 15/319 |
| 5,109,566 | A | 5/1992 | Kobayashi et al. | |
| 5,269,042 | A | 12/1993 | Stephens et al. | |
| 5,279,672 | A | 1/1994 | Betker et al. | |
| 5,321,614 | A | 6/1994 | Ashworth | |
| 5,341,540 | A | 8/1994 | Soupert et al. | |
| 5,377,106 | A | 12/1994 | Drunk et al. | |
| 5,542,146 | A | 8/1996 | Hoekstra et al. | |
| 5,613,261 | A | 3/1997 | Kawakami et al. | |
| 5,634,237 | A | 6/1997 | Paranjpe | |
| 5,940,927 | A | 8/1999 | Haegermarck et al. | |
| 6,076,227 | A | 6/2000 | Schallig et al. | |
| 6,459,955 | B1 * | 10/2002 | Bartsch et al. | 700/245 |
| 6,481,515 | B1 * | 11/2002 | Kirkpatrick et al. | 180/65.1 |
| 6,493,612 | B1 | 12/2002 | Bisset et al. | |
| 6,571,415 | B2 | 6/2003 | Gerber et al. | |
| 6,571,422 | B1 | 6/2003 | Gordon et al. | |
| 6,590,222 | B1 | 7/2003 | Bisset et al. | |
| 6,594,844 | B2 | 7/2003 | Jones | |
| 6,671,592 | B1 | 12/2003 | Bisset et al. | |
| 6,901,624 | B2 | 6/2005 | Mori et al. | |
| 7,079,923 | B2 * | 7/2006 | Abramson et al. | 700/245 |
| 7,155,308 | B2 * | 12/2006 | Jones | 700/245 |
| 7,167,775 | B2 * | 1/2007 | Abramson et al. | 700/245 |
| 7,430,455 | B2 * | 9/2008 | Casey et al. | 700/245 |
| 2003/0060928 | A1 * | 3/2003 | Abramson et al. | 700/245 |
| 2003/0120389 | A1 * | 6/2003 | Abramson et al. | 700/245 |
| 2006/0000052 | A1 | 1/2006 | Budd | |
| 2007/0100500 | A1 * | 5/2007 | Abramson et al. | 700/245 |
| 2008/0281481 | A1 * | 11/2008 | Abramson et al. | 701/23 |

OTHER PUBLICATIONS

H.R. Everett, Sensors for Mobile Robots, Theory and Application, Naval Command, Control and Ocean Surveillance Center, San Diego, California, A.K. Peter, Ltd. 1995, pp. 15-17 and 93-101.

Joseph L. Jones, et al., Mobile Robots, Inspiration to Implementation, Second Edition, A.K. Peters, Ltd. 1996, pp. 120-134.

* cited by examiner

SENSORS AND ASSOCIATED METHODS FOR CONTROLLING A VACUUM CLEANER

CROSS-REFERENCE TO RELATED PATENTS AND APPLICATIONS

This application is a Continuation-in-Part of U.S. utility patent application Ser. No. 10/665,709 filed on Sep. 19, 2003 now U.S. Pat. No. 7,237,298 and entitled "SENSORS AND ASSOCIATED METHODS FOR CONTROLLING A VACUUM CLEANER," the entirety of which is incorporated herein by reference.

BACKGROUND OF INVENTION

The invention relates to methods of controlling a vacuum cleaner using various types of sensors. It finds particular application in conjunction with a robotic vacuum having a controller, a cleaning head, and an interconnecting hose assembly and will be described with particular reference thereto. However, it is to be appreciated that the invention is also amenable to other applications. For example, a traditional upright vacuum cleaner, a traditional canister vacuum cleaner, a carpet extractor, other types of vacuum cleaners, and other types of robotic vacuums. More generally, this invention is amenable to various types of robotic household appliances, both indoor, such as floor polishers, and outdoor, such as lawnmowers or window washing robots.

It is well known that robots and robot technology can automate routine household tasks eliminating the need for humans to perform these repetitive and time-consuming tasks. Currently, technology and innovation are both limiting factors in the capability of household cleaning robots. Computer processing power, battery life, electronic sensors such as cameras, and efficient electric motors are all either just becoming available, cost effective, or reliable enough to use in autonomous consumer robots.

Generally, there are two standard types of vacuums: upright and canister. Uprights tend to be more popular in some countries and canisters in others. Each have their advantages and disadvantages. Recently, there has been patent activity in relation to propelled and autonomous canister-like vacuum cleaners.

Much of the work on robotic vacuum technology has centered on navigation and obstacle detection and avoidance. The path of a robot determines its success at cleaning an entire floor and dictates whether or not it will get stuck. Some proposed systems have two sets of orthogonal drive wheels to enable the robot to move directly between any two points to increase its maneuverability. Robotic vacuum cleaners have mounted the suction mechanisms on a pivoting or transverse sliding arm so as to increase the reach of the robot. Many robotic vacuums include methods for detecting and avoiding obstacles.

One of the issues with both robotic and manual vacuum cleaners is optimizing the height of a height adjust mechanism in relation to the subjacent surface to be cleaned. There is a particular need for an improved height adjustment mechanism for various types of vacuum cleaners, as well as other household appliances, both indoor and outside.

BRIEF SUMMARY OF INVENTION

The invention contemplates a vacuum cleaner that overcome at least one of the above-mentioned problems and others.

In one aspect of the invention, a vacuum cleaner includes a housing, a height adjust mechanism disposed on the housing and a height adjust motor, disposed within said housing that controls a height of the height adjust mechanism. A position element is mounted to said housing. A sensor processor, mounted to said housing, is in communication with the position element to provide a signal that relates to a position of the height adjust mechanism based at least in part upon data received from the position element. A controller processor, mounted to said housing, is in communication with the sensor processor for selectively controlling a height of the height adjust mechanism relative to a subjacent surface on which the vacuum cleaner is positioned. A height adjust mechanism height motor controller is in communication with the controller processor, for driving the height adjust motor to locate the height adjust mechanism in an appropriate position relative to the subjacent surface.

In another embodiment, a method of controlling a vacuum cleaner includes the steps of monitoring a height adjust motor feedback signal relating to operation of a corresponding height adjust motor associated with the vacuum cleaner, comparing the feedback signal to a predetermined threshold; and removing power from the height adjust motor and disabling operation of the height adjust motor when the feedback signal is less than the predetermined threshold.

In yet another embodiment, a vacuum cleaner comprises a height adjust mechanism base including a suction inlet and an upright housing pivotally mounted on said height adjust mechanism base. A suction source is disposed in one of said height adjust mechanism base and said housing, wherein said suction source is in fluid communication with said suction inlet. A floor sensor is mounted to one of said height adjust mechanism base and said housing. A sensor processor is mounted to one of said height adjust mechanism base and said housing, communicating with said floor sensor to provide a signal that relates to a position of said suction inlet in relation to a subjacent surface on which the vacuum cleaner is located. A height adjust mechanism is mounted to said height adjust mechanism base, said sensor processor communicating with said mechanism, wherein an output of said sensor processor controls an operation thereof. A manual control is located on one of said height adjust mechanism base and said housing for overriding said sensor processor and manually activating said mechanism.

Benefits and advantages of the invention will become apparent to those of ordinary skill in the art upon reading and understanding the description of the invention provided herein.

BRIEF DESCRIPTION OF DRAWINGS

The invention is described in more detail in conjunction with a set of accompanying drawings, wherein.

DETAILED DESCRIPTION

Figure 1:
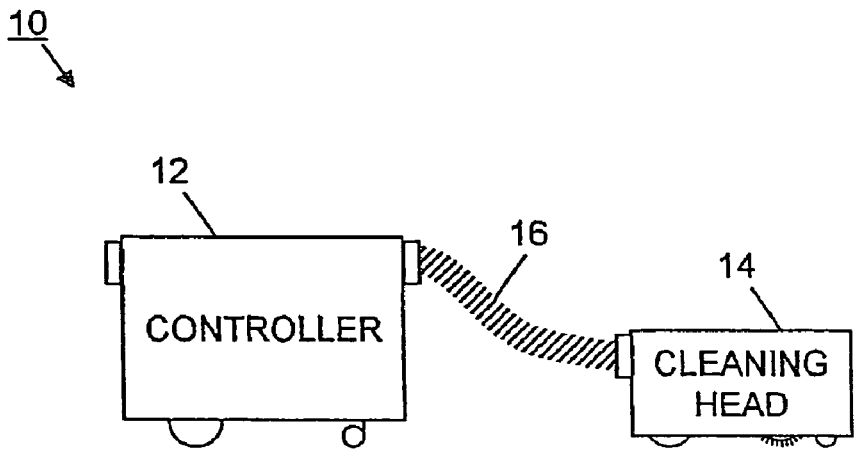
FIG. 1 is a functional block diagram of an embodiment of a robotic canister-like vacuum cleaner according to the present invention.

While the invention is described in conjunction with the accompanying drawings, the drawings are for purposes of illustrating exemplary embodiments of the invention and are not to be construed as limiting the invention to such embodiments. It is understood that the invention may take form in various components and arrangement of components and in various steps and arrangement of steps beyond those provided in the drawings and associated description. Within the drawings, like reference numerals denote like elements. It is to be appreciated that the invention is amenable to various applications. For example, a traditional upright vacuum cleaner, a traditional canister vacuum cleaner, a carpet extractor, other types of vacuum cleaners, and other types of robotic vacuums. More generally, this invention is amenable to various types of robotic household appliances, both indoor, such as floor polishers, and outdoor, such as lawnmowers or window washing robots.

With reference to FIG. 1, an embodiment of a robotic vacuum 10 includes a controller 12, a cleaning head 14 and a hose 16. The robotic vacuum 10 somewhat resembles conventional canister vacuum cleaners and may be referred to herein as a robotic canister-like vacuum, for the sake of convenience.

The controller 12 is in fluidic communication with the cleaning head 14 via a hose 16 for performing vacuuming functions. The controller is also in operative communication with the cleaning head 14 with respect to control functions. Essentially, in the embodiment being described, the controller 12 and the cleaning head 14 are separate housings and cooperate by moving in tandem across a surface area to vacuum dirt and dust from the surface during robotic operations. Typically, the cleaning head 14 acts as a slave to the controller 12 for robotic operations. Since the cleaning head 14 is separate from the controller 12 in a tandem configuration, the cleaning head 14 can be significantly smaller than the controller 12 and smaller than known one-piece robotic vacuums. The small cleaning head 14 is advantageous because it can access and clean small or tight areas, including under and around furniture.

The controller 12 performs mapping, localization, planning and control for the robotic vacuum 10. Typically, the controller 12 "drives" the robotic vacuum 10 throughout the surface area. While the controller is performing this function, it may also learn and map a floor plan for the surface area including any existing stationary objects. This includes: i) detecting characteristics of the environment, including existing obstacles, using localization sensors, ii) mapping the environment from the detected characteristics and storing an environment map in a controller processor 74 (FIG. 4), iii) determining a route for the robotic vacuum 10 to traverse in order to clean the surface area based on the environment map, and iv) storing the route for future reference during subsequent robotic operations. Thus, the controller 12 provides the robotic vacuum 10 with an automated environment-mapping mode. Automated environment mapping allows the vacuuming function to be performed automatically in future uses based on the mapped environment stored in the controller 12.

Figure 2:
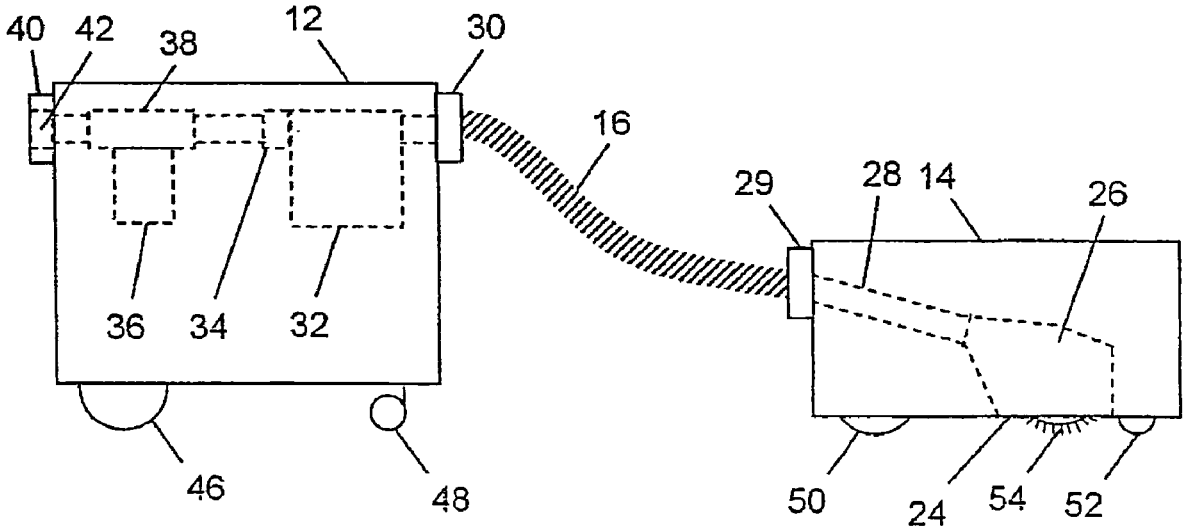
FIG. 2 is a functional block diagram showing a suction airflow path in an embodiment of the robotic canister-like vacuum cleaner of FIG. 1.

With reference to FIG. 2, various functions of the major components of the robotic vacuum 10 are shown, including the suction airflow path associated with vacuuming functions. The cleaning head 14 includes a suction inlet 24, a brush chamber 26, a suction conduit 28 and a cleaning head outlet 29. The controller 12 includes a vacuum inlet 30, a dirt receptacle 32, a primary filter 34, a suction motor 36, a suction fan 38, a vacuum outlet 40 and a secondary filter 42. As is well known, the suction fan 38 is mechanically connected to the suction motor 36. The suction fan 38 creates an airflow path by blowing air through the vacuum outlet 40. Air is drawn into the airflow path at the suction inlet 24. Thus, a suction airflow path is created between the suction inlet 24 and the suction fan 38. The vacuum or lower pressure in the suction airflow path also draws dirt and dust particles in the suction inlet 24. The dirt and dust particles flow through the hose 16 and are retained in the dirt receptacle 32. The dirt receptacle 32 may be dirt cup or a disposable bag, depending on whether a bag-less or bagged configuration is implemented.

Additionally, as shown in FIG. 2, the controller 12 can include at least one wheel 46 and a caster 48. The cleaning head 14 can also include at least one wheel 50, a caster 52 and a rotating brush roll 54, as is known in the art. Typically, the controller 12 and the cleaning head 14 both include two wheels and one or two casters. However, additional wheels, and/or additional casters may be provided. Likewise, tracked wheels can be used in addition to or in place of the wheels and casters. The wheels are driven to provide self-propelled movement. If the wheels (e.g., 46) are independently controlled, they may also provide steering. Otherwise, one or more of the casters (e.g., 48) may be controlled to provide steering. The configuration of wheel and casters in the cleaning head 14 may be the same or different from the configuration in the controller 12. Likewise, movement and steering functions in the cleaning head 14 may be implemented in the same manner as movement and steering functions in the controller 12, or in a different manner. For vacuuming, depending on the floor type, the brush 54 rotates and assists in the collection of dirt and dust particles.

Figure 3:
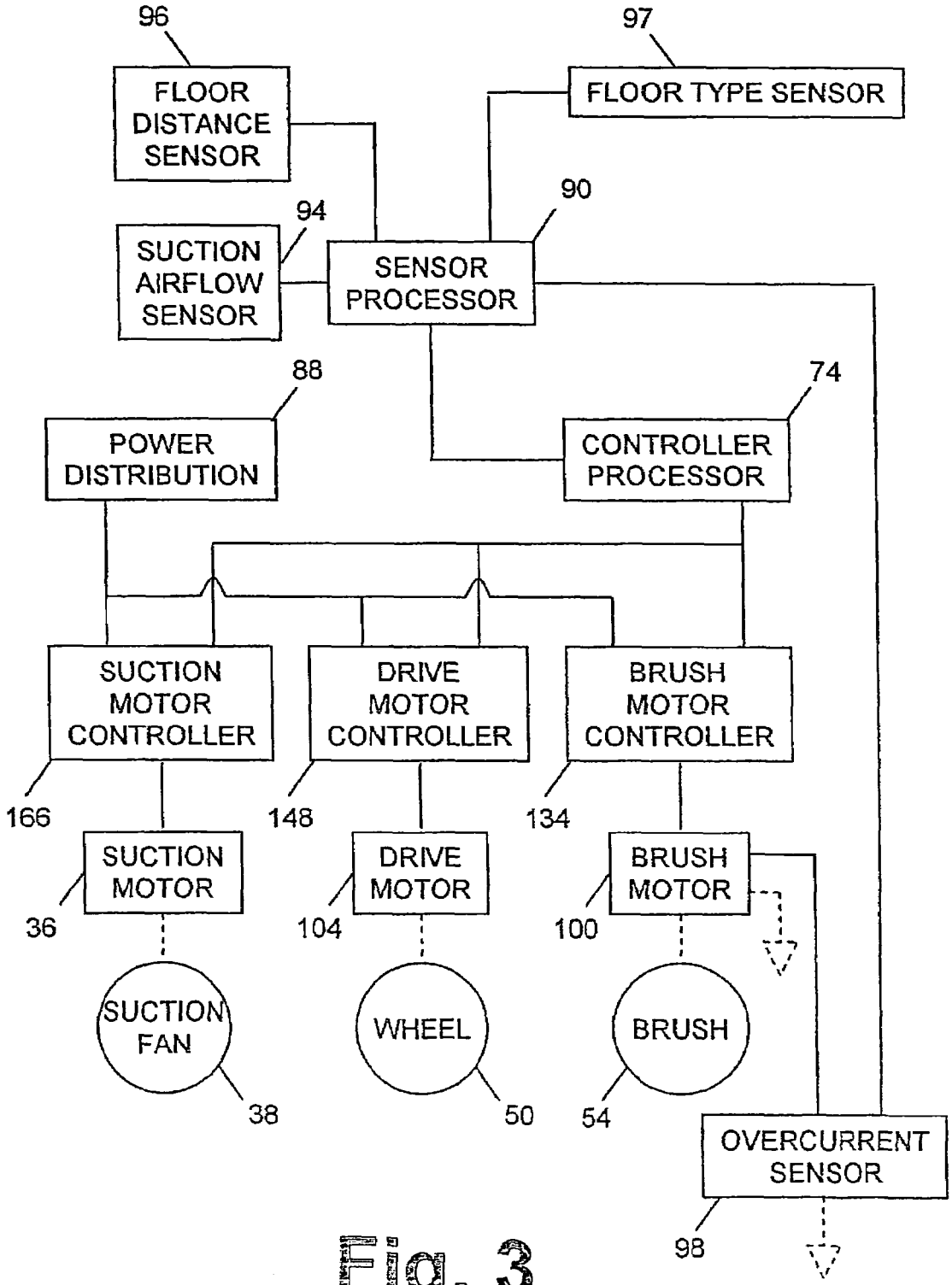
FIG. 3 is a functional block diagram of an embodiment of a robotic vacuum cleaner according to the present invention.

With reference to FIG. 3, an embodiment of the robotic vacuum cleaner 10 includes the suction motor 36, suction fan 38, wheel 50, brush 54, a controller processor 74, a power distribution 88, a sensor processor 90, a suction airflow sensor 94, a floor distance sensor 96, a floor type sensor 97, a brush motor overcurrent sensor 98, a brush motor 100, a drive motor 104, a brush motor controller 134, a drive motor controller 148, and a suction motor controller 166. In one embodiment, the brush 54 and the brush motor 100 can be combined to form a belt-less brush motor. In a belt-less brush motor, as is known, the motor is housed in the brush. An exemplary sensor processor 90 includes a microcontroller model no. PIC18F252 manufactured by Microchip Technology, Inc., 2355 West Chandler Blvd., Chandler, Ariz. 85224-6199.

Power distribution 88 receives power from a power source and distributes power to other components of an upright vacuum cleaner including the controller processor 74, sensor processor 90, brush motor controller 134, drive motor controller 148, and suction motor controller 166. The power source, for example, may be located in the controller 12 or in the cleaning head 14; or divided between both the controller 12 and the cleaning head 14. Power distribution 88 may be a terminal strip, discreet wiring, or any suitable combination of components that conduct electrical power to the proper components. For example, if any components within an upright vacuum cleaner require a voltage, frequency, or phase that is different than that provided by the power source, power distribution 88 may include power regulation, conditioning, and/or conversion circuitry suitable to provide the required voltage(s), frequencies, and/or phase(s). In one embodiment, the power source is in the controller 12 (FIG. 2) and provides power to the cleaning head 14. In this embodiment, power is distributed from the controller 12 (FIG. 2) along wires within the hose 16 (FIGS. 1 and 2) to power distribution 88 for distribution throughout the cleaning head.

The sensor processor 90 processes information detected by the suction airflow sensor 94, floor distance sensor 96, floor type sensor 97, and overcurrent sensor 98. The sensor processor 90, for example, can be in communication with the controller processor 74 via discrete control signals communicated through hose 16 (FIGS. 1 and 2). The controller processor 74 can control the brush 54, wheel(s) 50, and suction fan 38 via brush motor controller 134, drive motor controller 148, and suction motor controller 166, respectively. Alternatively, the controller processor 74 may control one or more motors directly or via any type of suitable known device.

The suction airflow sensor 94, in combination with the sensor processor 90, detects if there is an obstruction in the suction airflow path of the vacuum cleaner. If there is an obstruction, the sensor processor 90 issues a visual indication via LED and a control signal to the controller processor 74 to shut the suction motor 36 off. If the suction motor 36 is not shut off when there is an obstruction in the suction airflow path, the suction motor 36 increases its speed. This can cause catastrophic failure to the suction motor 36 and potentially to the vacuum cleaner 10. The suction airflow sensor can be calibrated to be used as a maintenance sensor (for example clean filter, empty dirt receptacle, or change bag).

The suction airflow sensor 94, in combination with the sensor processor 90, detects an obstruction in the suction airflow path. In one embodiment, the suction airflow sensor 94 performs a differential pressure measurement between ambient air and the suction airflow path. In this embodiment, one of the differential pressure ports of the suction airflow sensor 94 is tapped to the atmosphere and the other port includes tapped to the suction airflow path. An exemplary differential pressure sensor includes Model No. MPS5010 manufactured by Motorola, Inc. The sensor processor 90 can distinguish between a foreign object obstruction condition, a full dirt receptacle 32 (FIG. 2), and when the primary filter 34 (FIG. 2) needs to be changed. If desired, the sensor processor 90 can communicate the detected conditions to the controller processor 74 and the controller processor can determine whether the suction motor 36 (FIG. 2), brush motor 100 and drive motors 104 should be shut down or controlled differently and/or whether associated indicators should be illuminated and/or annunciators (i.e., alarms) should be sounded. Once the controller processor 74 determines a course of action, it communicates appropriate instructions to the appropriate motor controllers (i.e., 134, 148, 166).

In self-propelled vacuum cleaners, particularly a robotic vacuum cleaner, catastrophic failure will occur if stairs or other potential height changes in floor surfaces are not detected. To this end, the floor distance sensor 96, in combination with the sensor processor 90, detects height changes in floor surfaces and issues a control signal to the controller processor 74 for a stop and reverse command so that an upright vacuum cleaner does not tumble down the stairs.

The floor distance sensor 96, in combination with the sensor processor 90, detects a drop-off in the floor that would cause the cleaning head 14 to hang up or fall. For example, the floor distance sensor 96 detects when the cleaning head 14 is at the top of a staircase or when the cleaning head approaches a hole or substantial dip in the surface area being traversed. In one embodiment, the floor distance sensor 96 can include two infrared (IR) sensors mounted approximately 5 cm off the ground at about a 20° angle normal to vertical. An exemplary IR floor distance sensor includes Sharp model no. GP2D120 manufactured by Sharp Corp., 22-22 Nagaiko-Cho, Abeno-Ku, Osaka 545-8522, Japan. The floor distance sensor 96 can communicate information to the sensor processor 90. In turn, the sensor processor 90 can communicate the detected conditions to the controller processor 74. The controller processor 74 controls the drive motors 104 to maneuver, for example, the cleaning head 14 in order to avoid the surface area when a hazardous surface condition is detected.

In combination with the sensor processor 90, the floor type sensor 97 can detect if a floor is carpeted or not. This is important since typically it is preferred to shut off the brush 54 if the vacuum cleaner is on a bare floor (e.g., hardwood floors, etc.) to protect the floor from damage caused by the brush.

The floor type sensor 97, in combination with the sensor processor 90, detects the type of floor being traversed and distinguishes between carpeted and non-carpeted surfaces. Floor type information is communicated to the controller processor 74. Typically, the controller processor 74 operates the brush motor 100 to spin the brush 54 when the surface area is carpeted and stops the brush motor 100 when non-carpeted surfaces are being cleaned. In one embodiment, the floor type sensor can use sonar to detect floor type. If used, a sonar floor type sensor can be mounted approximately 3 inches off the floor and can run at approximately 220 kHz. Using this arrangement, the sonar sensor can distinguish between, for example, low cut pile carpet and linoleum. Suitable sonar floor type sensors include sonar floor type sensors from Massa Products, a corporation of Hingham, Mass.

The overcurrent sensor 98, in combination with the sensor processor 90, can detect an unsafe current level in the brush motor 100. In operation, an upright vacuum cleaner has the potential of picking up items (e.g., rags, throw rugs, etc.) that can jam the brush 54. When this happens the brush motor 100 can be in a locked rotor position causing the current and the motor to rise beyond its design specifications. An overcurrent sensor, in combination with the sensor processor 90, can detect this condition and turn off the brush motor 100 to avoid the potentially hazardous condition.

The overcurrent sensor 98, in combination with the sensor processor 90, can provide locked rotor and overcurrent protection to the brush motor 100. If the brush motor 100, for example, jams, brush motor current is increased. In one embodiment, the overcurrent sensor 98 can be an overcurrent feedback module associated with the brush motor 100. For example, if the brush motor is a brushless DC motor, the overcurrent feedback module can sense motor RPMs. Similarly, if the brush motor is a servo motor, the overcurrent feedback module can sense average torque on the motor. Additionally, the overcurrent feedback module may be an encoder that detects and measures movement of the brush motor shaft. In another embodiment, the overcurrent sensor 98 can be an electronic circuit that senses brush motor current and, in combination with the sensor processor 90, removes power from the brush motor 100 when an overcurrent condition is sensed. The overcurrent sensor 98 can be reset after, for example, a throw rug jamming the brush 54 is removed from the suction inlet 24 (FIG. 2). Also, the sensor processor 90 may communicate the overcurrent condition information to the controller processor so that additional appropriate actions can be taken during in overcurrent condition. For example, such actions can be stopping movement of the robotic vacuum 10 and activation of appropriate indicators and/or alarms.

Either the controller processor 74 or the sensor processor 90 can control drive functions for the cleaning head 14. The controller processor 74 is in communication with the drive motor 104 and associated steering mechanism. In one embodiment, the steering mechanism may move the caster 52 (FIG. 2) to steer the cleaning head 14. The drive motor 104 is in operative communication with the wheel 50 to turn the wheel forward or backward to propel the cleaning head 14. In another embodiment, the drive motor 104 may simultaneously control two wheels 50 and the steering mechanism may control the caster 52 (FIG. 2).

Figure 9:
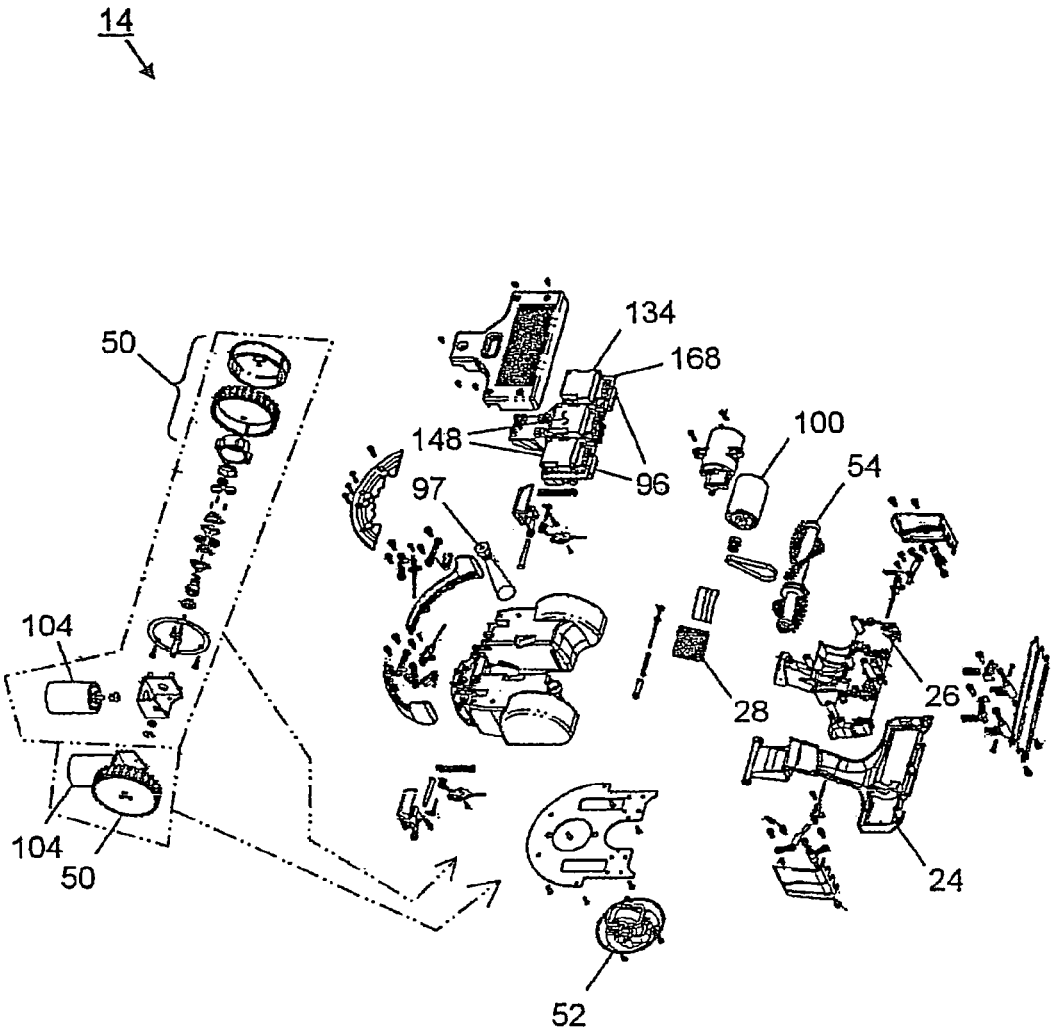
FIG. 9 is an exploded view an embodiment of a cleaning head associated with the robotic canister-like vacuum cleaner of FIGS. 1 and 2.

In still another embodiment, having two casters 54 (FIG. 2), the steering mechanism controls may control both casters independently or by a linkage between the casters. Alternatively, the additional caster may be free moving (i.e., freely turning about a vertical axis). If the cleaning head 14 includes additional casters, they may be free moving or linked to the steered caster(s). In yet another embodiment, as shown in FIG. 9, the cleaning head 14 can include two independent drive motors 104 and the processor can independently control the two wheels 50 to provide both movement and steering functions. In this embodiment, each independently controlled drive motor 104/wheel 50 combination provides forward and backward movement. For this embodiment, the controller processor 74 would control steering by driving the drive motor 104/wheel 50 combinations in different directions and/or at different speeds. Thus, a separate steering mechanism is not required.

The wheel 46, caster 48, and drive motor of the controller 12 (FIG. 2) typically operate in the same manner as like components described above for the cleaning head 14. Likewise, the various alternatives described above for the drive and steering components in the cleaning head 14 are available for the drive and steering components in the controller 12. It should also be appreciated that the wheel 46, caster 48, and drive motor of the controller 12 may implement one of the alternatives described above while the cleaning head 14 implements a different alternative.

In various embodiments, the functions performed by the controller processor 74 and sensor processor 90 may be combined in one or more processors or divided differently among two or more processors. The resulting processor(s) may be located in the controller 12 or the cleaning head 14 or divided between the controller 12 and the cleaning head 14. In the embodiment being described, the controller 12 and cleaning head 14 are typically assembled in separate housings. The various components depicted in FIG. 3 may be installed in either housing, unless the function of the component dictates that it must be installed in either the controller 12 or the cleaning head 14. For example, the brush 54 and brush motor 100 typically must be installed in the cleaning head. Alternatively, the components depicted in FIG. 3 may be embodied in a robotic vacuum cleaner having a single housing rather than the tandem configuration shown in FIGS. 1 and 2.

Figure 4:
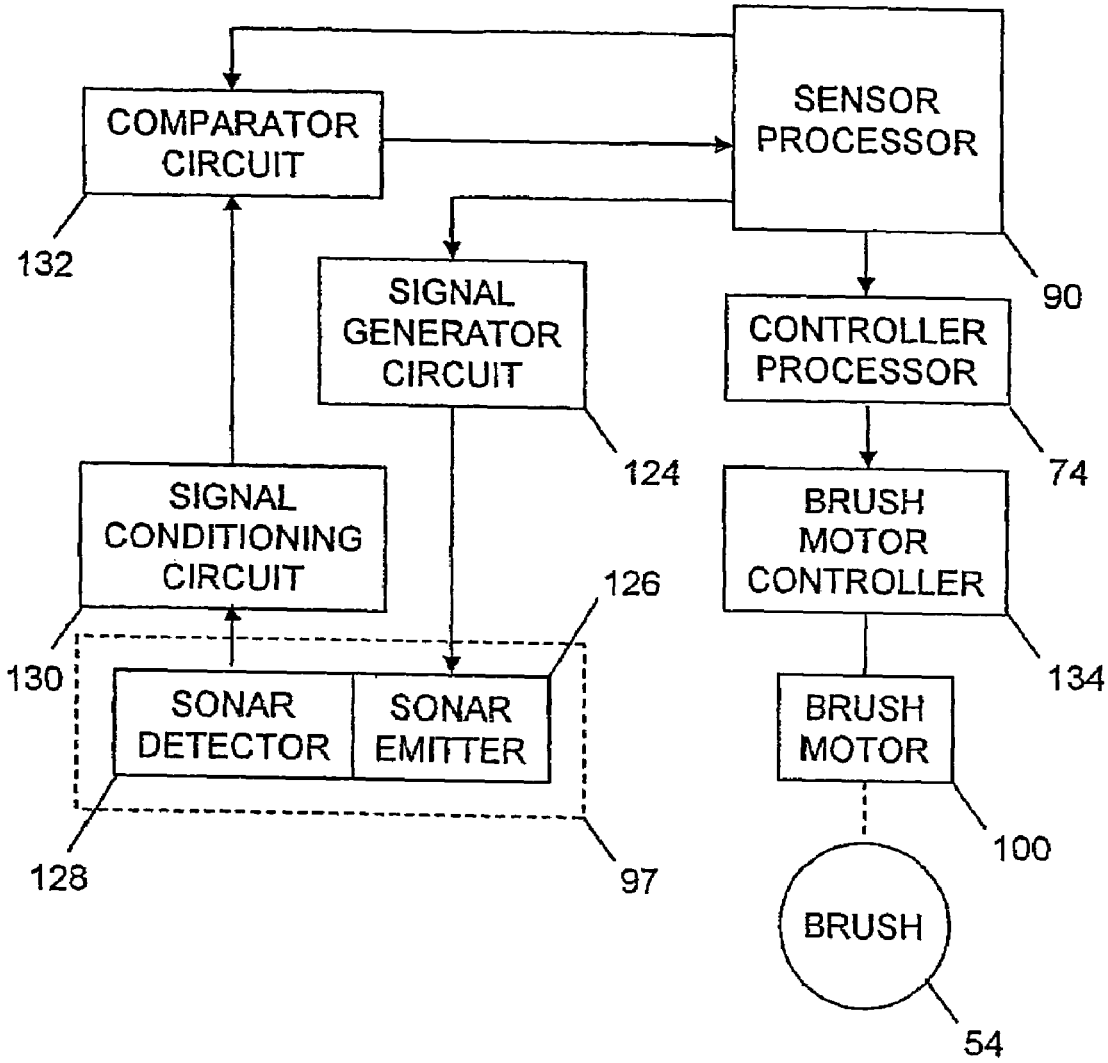
FIG. 4 is a more detailed functional block diagram of an embodiment of a vacuum cleaner circuit including a floor type sensor of FIG. 3.

With reference to FIG. 4, a vacuum cleaner circuit with a floor type sensor 97 also includes the brush 54, controller processor 74, sensor processor 90, brush motor 100, brush motor controller 134, a signal generator circuit 124, a signal conditioning circuit 130, and a comparator circuit 132. In one embodiment, the floor type sensor 97 is based on sonar technology and includes a sonar emitter 126 and a sonar detector 128.

The sensor processor 90 can communicate a control signal to the signal generator circuit 124. In turn, the signal generator circuit 124 can provide a drive signal to the sonar emitter 126. The control and drive signals may, for example, be about 416 KHz. Normally, the drive signal would be a high voltage stimulus that causes the sonar emitter 126 to emit sonic energy in the direction of the floor to be sensed. Such energy is either reflected (in the case of a hard floor) or partially absorbed and scattered (in the case of a soft or carpeted floor). The reflected sonic energy is received by the sonar detector 128 and converted to an electrical signal provided to the signal conditioning circuit 130. In turn, the signal conditioning circuit 130 conditions and filters the detected signal so that it is compatible with the comparator circuit 132. If desired, the comparator circuit 132 can be programmable and can receive a second input from the sensor processor 90. The input from the sensor processor 90 can act as a threshold for comparison to the detected signal. One or more predetermined threshold values may be stored in the sensor processor 90 and individually provided to the comparator circuit 132. The output of the comparator circuit 132 can be monitored by the sensor processor 90.

The comparator circuit 132 may be implemented by hardware or software. For example, in one embodiment the sensor processor 90 may include a look-up table (LUT) and a comparison process may include matching the detected signal to values in the look-up table where values in the look-up table identify thresholds for the detected signal for various types of floor surfaces. For example, hard floor surfaces, such as concrete, laminate, ceramic, and wood, and soft floor surfaces, such as sculptured carpet, low pile carpet, cut pile carpet, and high pile carpet.

The sensor processor 90 identifies the type of floor being traversed by the vacuum cleaner and communicates type of floor information to the controller processor 74. Based on the type of floor information, the controller processor 74 determines whether or not to operate the brush motor and provides a control signal to the brush motor controller 134 to start or stop the brush motor 100. The controller processor 74 may also control the speed of the brush motor 10 via the brush motor controller 134 if variations in speed, based on the type of floor detected, are desirable.

The brush motor controller 134, brush motor 100, and brush 54 operate as described above in relation to FIG. 3. In an alternate embodiment the brush motor controller 134 may not be required and either the controller processor 74 or the sensor processor 90 may directly control the brush motor 100. In still another embodiment, the sensor processor 90 may directly control the brush motor controller 134.

The vacuum cleaner circuit with the floor type sensor which has been described above, may be implemented in a robotic vacuum cleaner, a robotic canister-like vacuum cleaner, a hand vacuum cleaner, a carpet extractor, a canister vacuum cleaner, an upright vacuum cleaner, and similar indoor cleaning appliances (e.g., floor scrubbers) and outdoor cleaning appliances (e.g., street sweepers) that include rotating brushes.

Figure 5:
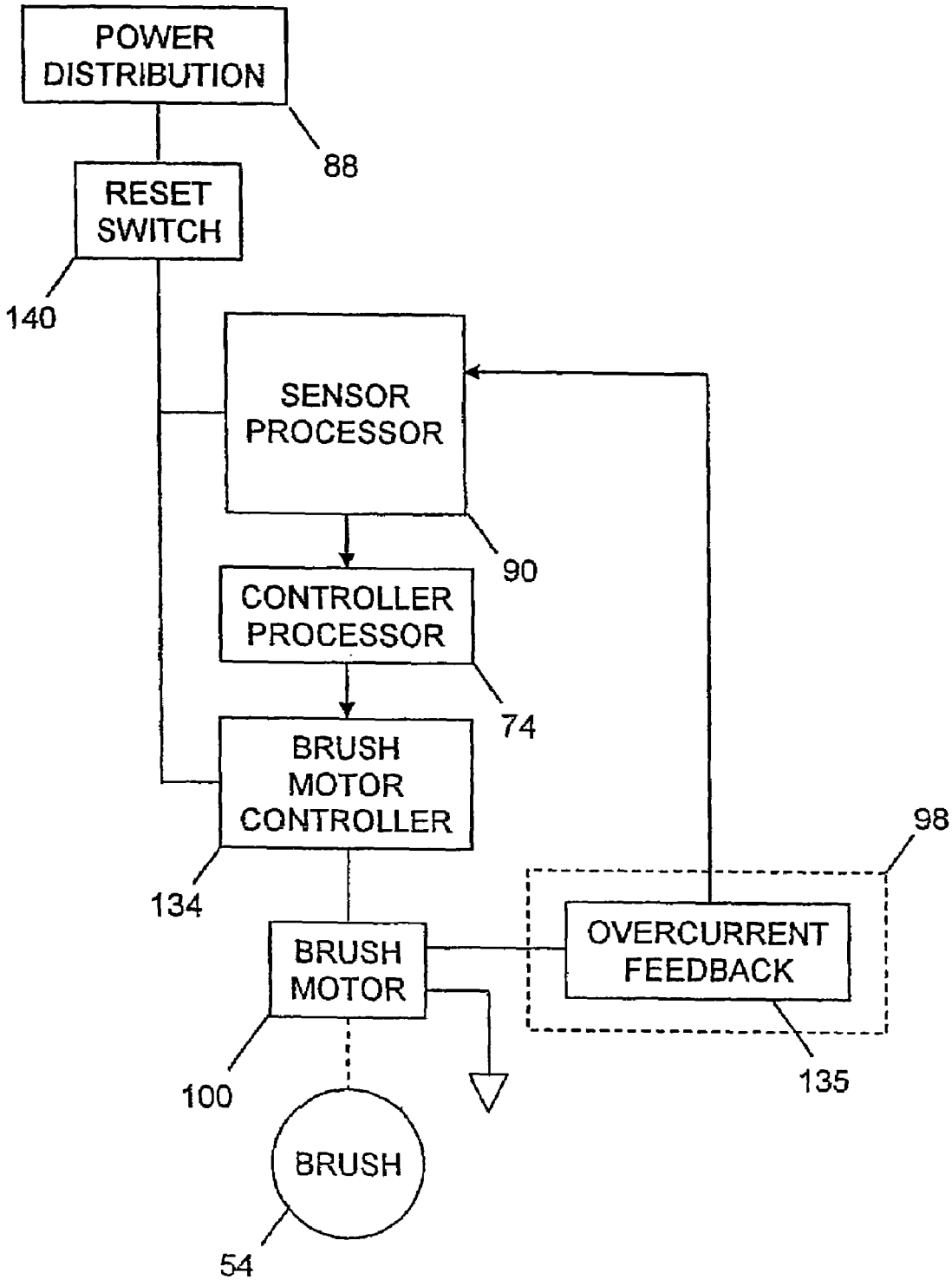
FIG. 5 is a more detailed functional block diagram of an embodiment of a vacuum cleaner circuit including a brush motor overcurrent sensor of FIG. 3.

With reference to FIG. 5, a vacuum cleaner circuit with a brush motor overcurrent sensor 98 also includes the brush 54, controller processor 74, power distribution 88, sensor processor 90, brush motor 100, brush motor controller 134 and a reset switch 140. In one embodiment, the overcurrent sensor 98 includes an overcurrent feedback module 135. The overcurrent feedback module 135, for example, may provide information associated with brush motor RPM, brush motor torque, quantity of brush motor revolutions, and/or distance of brush motor rotation. For example, where the brush motor is a brushless DC motor, the overcurrent feedback module 135 may provide information associated with brush motor RPM. Alternatively, where the brush motor is a servo motor, the overcurrent feedback module 135 may provide information associated with brush motor torque. For various types of brush motors, the overcurrent feedback module 135 may include, for example, encoders that provide information associated with the quantity of brush motor revolutions from a given point and/or the distance of brush motor rotation from a given point.

During operation of the brush motor 100, power flows from power distribution 88 through the reset switch 140 and the brush motor controller 134 to the brush motor 100. In the embodiment being described, the return path for power is connected to the brush motor 100. The sensor processor 90 monitors, for example, brush motor RPM via the overcurrent feedback module 135 and determines whether an overcurrent condition exists based on the brush motor RPM. The sensor processor 90 may, alternatively, monitor brush motor torque, brush motor revolutions, or distance of brush motor rotation as described above. The sensor processor 90 can compare the information provided by the overcurrent feedback module 135 to a predetermined threshold. If the feedback information is less than the predetermined threshold, the sensor processor 90 can send a control signal to the controller processor 74 and/or brush motor controller 134 to open the power connection to the brush motor 100. In the embodiment being described, the brush motor controller 134 remains open until the reset switch 140 is manually activated, thereby cycling power to the brush motor controller 134 and applying a control activation signal to the sensor processor 90. In other embodiments, the brush motor controller 134 may be reset by other suitable means. Once power is cycled by activation of the reset switch 140, the sensor processor 90 sends a control signal to close the power connection in the brush motor controller 134, thus enabling power to flow to the brush motor 100 through the brush motor controller 134.

The sensor processor 90 may communicate conditions associated with brush motor current to the controller processor 74. In turn, the controller processor 74 may use brush motor current information to control operation of the brush motor 100, including on/off and/or speed control. The brush motor controller 134, brush motor 100, and brush 54 can operate in the same manner as described above in reference to FIG. 3.

The vacuum cleaner circuit with the brush motor overcurrent sensor may be implemented in a robotic vacuum cleaner, a robotic canister-like vacuum cleaner, a hand vacuum cleaner, a carpet extractor, a canister vacuum cleaner, an upright vacuum cleaner, and similar household cleaning appliances that include a brush motor.

Figure 6:
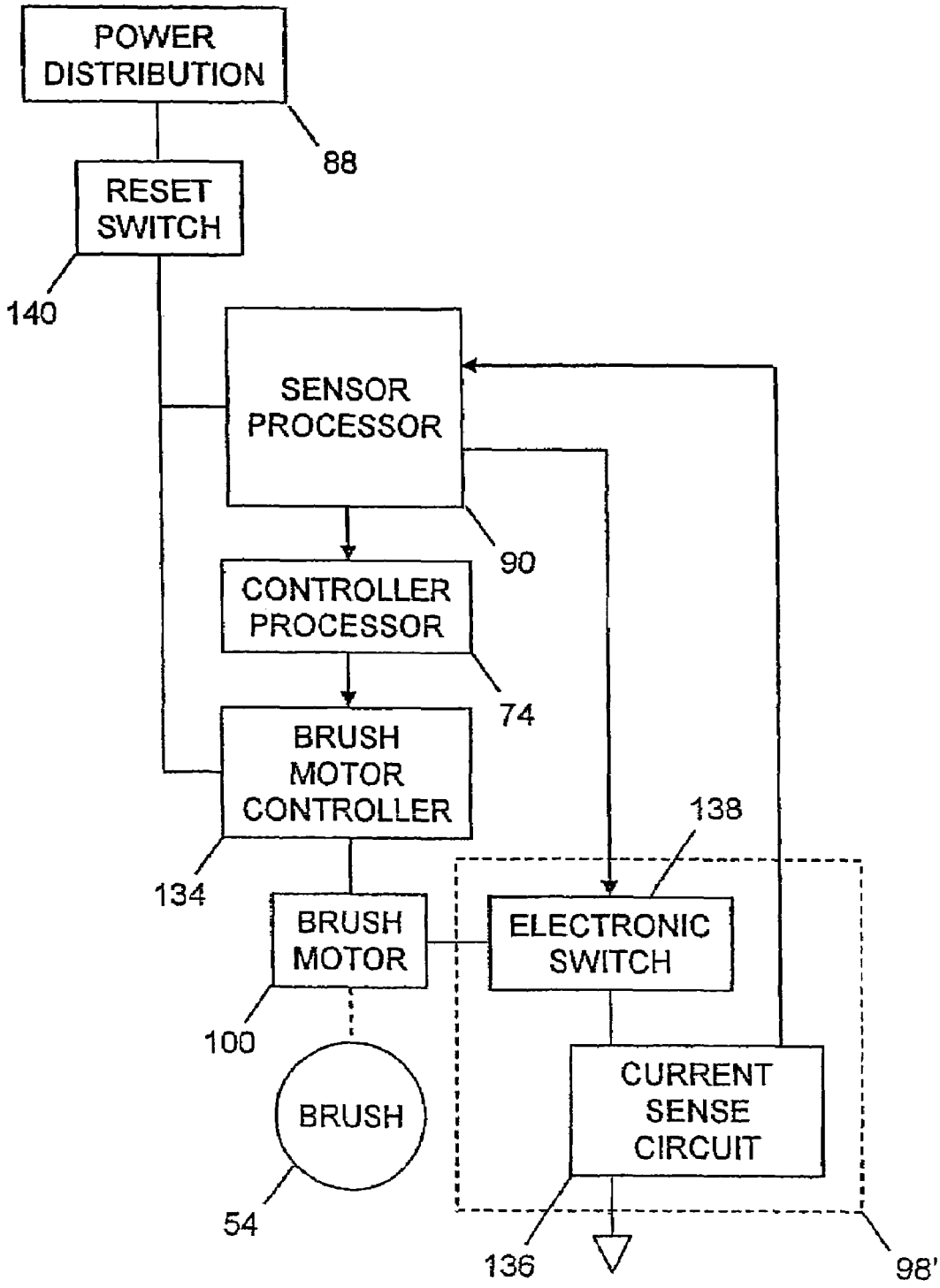
FIG. 6 is a functional block diagram of another embodiment of a vacuum cleaner circuit including the brush motor overcurrent sensor of FIG. 3.

With reference to FIG. 6, another embodiment of a vacuum cleaner circuit with a brush motor overcurrent sensor 98' also includes the brush 54, controller processor 74, power distribution 88, sensor processor 90, brush motor 100, brush motor controller 134 and a reset switch 140. In one example of the embodiment being described, the overcurrent sensor 98' includes a current sense circuit 136 and an electronic switch 138. An exemplary current sense circuit 136 includes a 0.05 ohm resistor, a 1K ohm resistor, and a 0.1 μF capacitor. An exemplary electronic switch 138 includes a field effect transistor (FET), a 1K ohm resistor, and a 10K ohm resistor.

During operation of the brush motor 100, power flows from power distribution 88 through the reset switch 140 and the brush motor controller 134 to the brush motor 100. In the embodiment being described, the overcurrent sensor 98' is in the return path between the brush motor 100 and ground. In other embodiments, the overcurrent sensor 98' may be located at other points in the brush motor current path. The sensor processor 90 monitors brush motor current via the current sense circuit 136. This circuit may include a current sense resistor that converts motor current to a voltage signal that is filtered and provided to the sensor processor 90. The sensor processor 90 can compare the sensed current to a predetermined threshold. If the sensed current exceeds the predetermined threshold, the sensor processor 90 can send a control signal to the electronic switch 138 to open the return path for power to the brush motor 100. In the embodiment being described, the electronic switch 138 remains open until the reset switch 140 is manually activated, thereby cycling power to the brush motor controller 134 and applying a control activation signal to the sensor processor 90. In other embodiments, the electronic switch 138 may be reset by other suitable means. Once power is cycled by activation of the reset switch 140, the sensor processor 90 sends a control signal to close the electronic switch 138, thus enabling power to flow through the brush motor 100 via the brush motor controller 134 under control of the controller processor 74 and sensor processor 90.

The sensor processor 90 may communicate conditions associated with brush motor current to the controller processor 74. In turn, the controller processor 74 may use brush motor current information to control operation of the brush motor 100, including on/off and/or speed control. The brush motor controller 134, brush motor 100, and brush 54 can operate in the same manner as described above in reference to FIG. 3.

The vacuum cleaner circuit with the brush motor overcurrent sensor may be implemented in a robotic vacuum cleaner, a robotic canister-like vacuum cleaner, a hand vacuum cleaner, a carpet extractor, a canister vacuum cleaner, an upright vacuum cleaner, and similar household cleaning appliances that include a brush motor.

Figure 7:
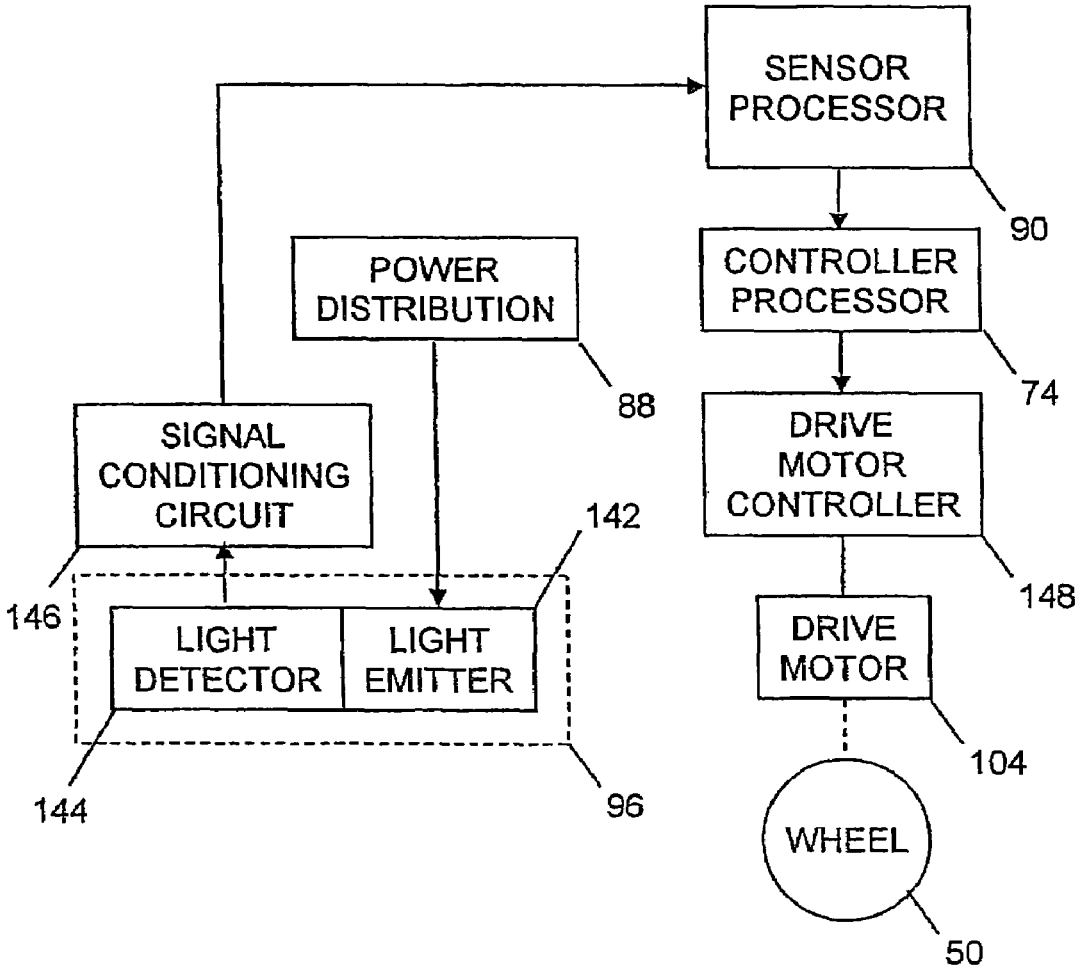
FIG. 7 is a more detailed functional block diagram of an embodiment of a vacuum cleaner circuit including a floor distance sensor of FIG. 3.

In reference to FIG. 7, a vacuum cleaner circuit with a floor distance sensor 96 also includes the wheel 50, controller processor 74, power distribution 88, sensor processor 90, drive motor 104, drive motor controller 148 and signal conditioning circuit 146. In one embodiment, the floor distance sensor includes a light emitter 142 and a light detector 144.

The power distribution 88 applies power to the light emitter 142. The light emitter 142 emits light energy toward a surface of a floor toward which the vacuum cleaner is advancing. Detecting the amount of light reflected by the floor is the light detector 144. The amount of light detected is indicative of the distance to the surface of the floor. Providing a detected signal to the signal conditioning circuit 146 is the light detector 144. The signal conditioning circuit 146 conditions and filters the signal for the sensor processor 90. Comparing the conditioned signal to a predetermined threshold is the sensor processor 90 to determine if there is a sudden increase in the distance, such as would occur when the vacuum cleaner approaches the edge of a downward staircase. The specific values of this distance threshold are programmable and dependent on sensor mounting and view angles. Two floor distance sensors 96 can be mounted on opposite edges of the vacuum cleaner to detect a stair edge when the vacuum cleaner is moving at any angle to a drop-off in the surface of the floor.

The sensor processor 90 identifies conditions in the floor surface that may be hazardous for a self-propelled vacuum cleaner. These potential hazardous conditions are communicated to the controller processor 74. The controller processor 74 controls the drive motor controller 148, which in turn controls the speed and direction of the drive motor 104 so that the vacuum cleaner avoids the potential hazardous condition. For example, when a potential hazardous condition is detected, the controller processor 74 may implement a control procedure that stops the vacuum cleaner from advancing, reverses the vacuum cleaner to back away from the potential hazardous surface condition, and activates localization sensors to localize the vacuum cleaner within the environment to be cleaned. Alternatively, the controller processor 74 may implement an edge following routine using the floor distance sensor 96 to advance the vacuum cleaner along the edge of the potentially hazardous surface condition. If desired, the drive motor controller 148, drive motor 104, and wheel 50 can operate in the same manner as described above in reference to FIG. 3. Likewise, as described above, multiple pairs of drive motors 104 and wheels 50 can be implemented and independently controlled to steer the vacuum cleaner. Alternatively, a steering mechanism can be implemented and controlled in conjunction with control of the drive motor 104 to avoid the potentially hazardous condition.

The vacuum cleaner circuit with the floor distance sensor may be implemented in a robotic vacuum cleaner, a robotic canister-like vacuum cleaner, a self-propelled carpet extractor, a self-propelled canister vacuum cleaner, a self-propelled upright vacuum cleaner, and similar cleaning units (e.g., street sweeper, lawn mower, floor polisher) that are self-propelled.

Figure 8:
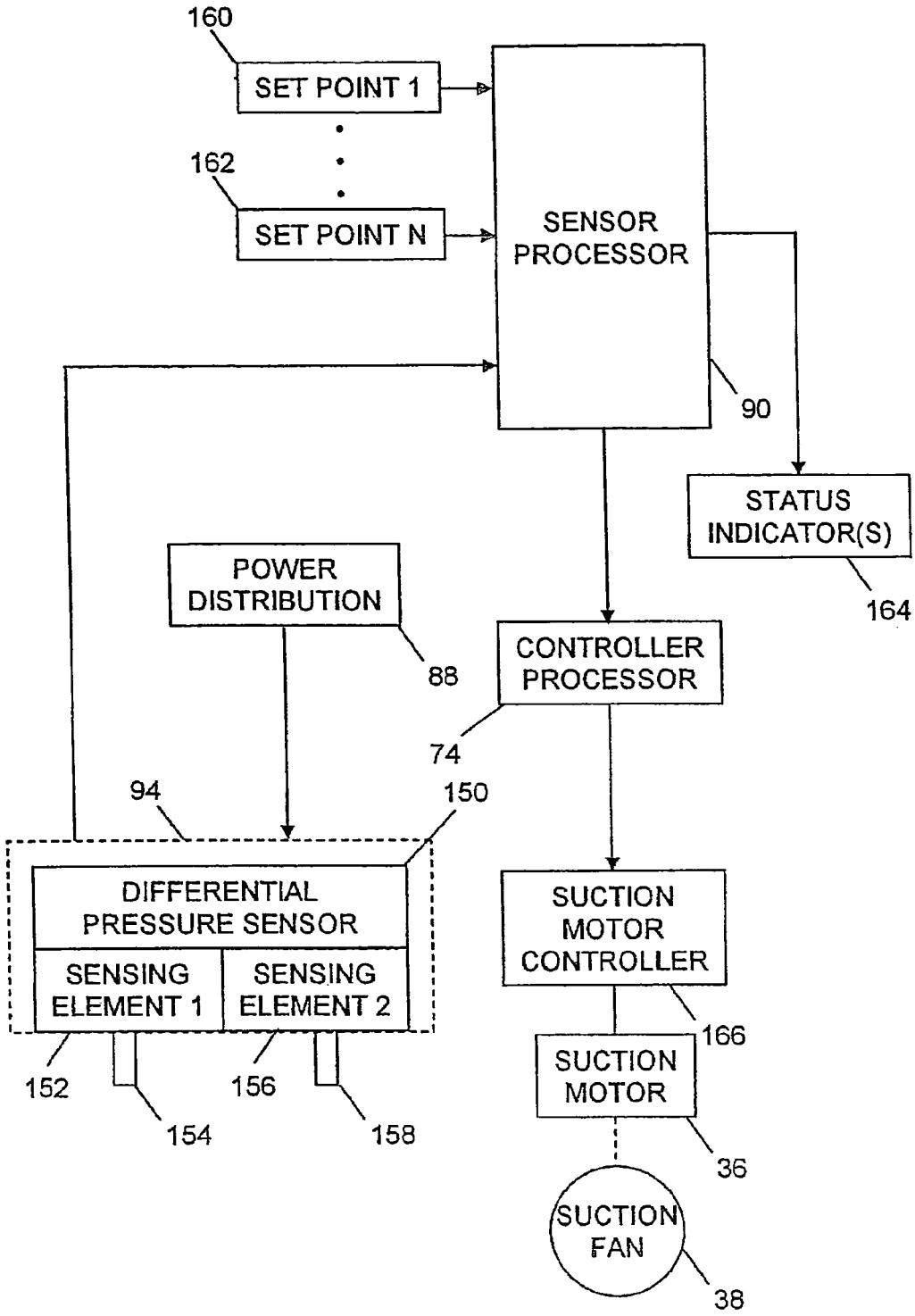
FIG. 8 is a more detailed functional block diagram of an embodiment of a vacuum cleaner circuit including a suction airflow sensor of FIG. 3.

With reference to FIG. 8, a vacuum cleaner circuit with a suction airflow sensor 94 also includes the suction motor 36, suction fan 38, controller processor 74, power distribution 88, sensor processor 90, suction motor controller 166, a plurality of set points (including a first set point 160 and an Nth set point 162), and one or more status indicator(s) 164. In one embodiment, the suction airflow sensor 94 includes a differential pressure sensor 150 with a first sensing element 152, a first pressure sensing port 154, a second sensing element 156, and a second pressure sensing port 158. The first sensing port 154 is associated with the first sensing element 152 and the second sensing port 158 is associated with the second sensing element 156.

The differential pressure sensor 150 converts a difference in pressure across the two sensing ports to a signal that is provided to the sensor processor 90. The sensor processor 90 compares the sensed signal to one or more predetermined set points (160, 162). Any or all set points can be implemented in hardware (e.g., variable resistors) or software. Depending on the results of the comparison, the sensor processor 90 updates the one or more status indicators 164 to reflect the sensed differential pressure.

One sensing port (e.g., 154) can measure the pressure in the suction airflow path and the other sensing port (e.g., 158) can measure the pressure of ambient air near the vacuum cleaner. The difference in pressure can be used to determine varying degrees of obstruction within the suction airflow path. For example, individual set points (e.g., 160, 162) can be calibrated to represent thresholds for differential pressure measurements that are expected when the suction airflow path is obstructed by a foreign object, when a dirt receptacle associated with the vacuum cleaner is generally full, and when a filter associated with the vacuum cleaner is generally blocked. In other words, the first set point 160 may be adjusted to act as a threshold for determining when the suction airflow path is obstructed by a foreign object, a second set point may be adjusted to act as a threshold for determining when the dirt receptacle is generally full, and a third set point may be adjusted to act as a threshold for determining when the filter is generally blocked.

The status indicator 164 may include an illuminated indicator, an annunciator, or a combination of both. If the sensor processor 90 can identify multiple conditions for the vacuum cleaner based on different differential pressure measurements, it is preferred that the status indicator be able to provide multiple types of indicator sequences with a unique indicator sequence associated with each unique detectable condition. The illuminated indicator can have multiple illuminated display sequences and the annunciator can have multiple audible tone sequences.

For example, the illuminated indicator may include a tricolor LED with red, yellow, and green sections. The sensor processor 90 may illuminate the red section when the suction airflow path is obstructed by a foreign object and the yellow section when the dirt receptacle is generally full. The sensor processor 90 may illuminate and flash the yellow section when the filter is generally blocked, and the green section when the suction airflow path is suitable for normal vacuuming operations. Of course, alternate color schemes and alternate display characteristics are also possible. The annunciator may be used in combination with the illuminated indicator or in place of the illuminated indicator. Similarly, the sensor processor 90 can control the annunciator to sound unique audible tone sequences for each detectable condition.

The vacuum cleaner circuit with the suction airflow sensor may be implemented in a robotic vacuum cleaner, a robotic canister-like vacuum cleaner, a hand vacuum cleaner, a carpet extractor, a canister vacuum cleaner, a stick vacuum cleaner, an upright vacuum cleaner, and any other type of cleaning unit (e.g., street sweeper) that includes a suction airflow path.

With reference to FIG. 9, an exploded view of an embodiment of a cleaning head 14 associated with a canister-like vacuum cleaner 10 is provided. This view shows the suction inlet 24, brush chamber 26, suction conduit 28, two wheels 50, caster 52, brush 54, two floor distance sensors 96, a floor type sensor 97, a brush motor 100, two drive motors 104, a brush motor controller 134, two drive motor controllers 148, and a circuit card assembly 168. The circuit card assembly 168 may include various components and one or more of the electronic circuits described above, including the sensor processor 90, suction airflow sensor 94; and overcurrent sensor 98. Of course, electronic circuits and various components could be divided among multiple circuit card assemblies in any suitable manner. Similarly, the circuit card assemblies may be disposed in any suitable location throughout the vacuum cleaner.

Figure 10:
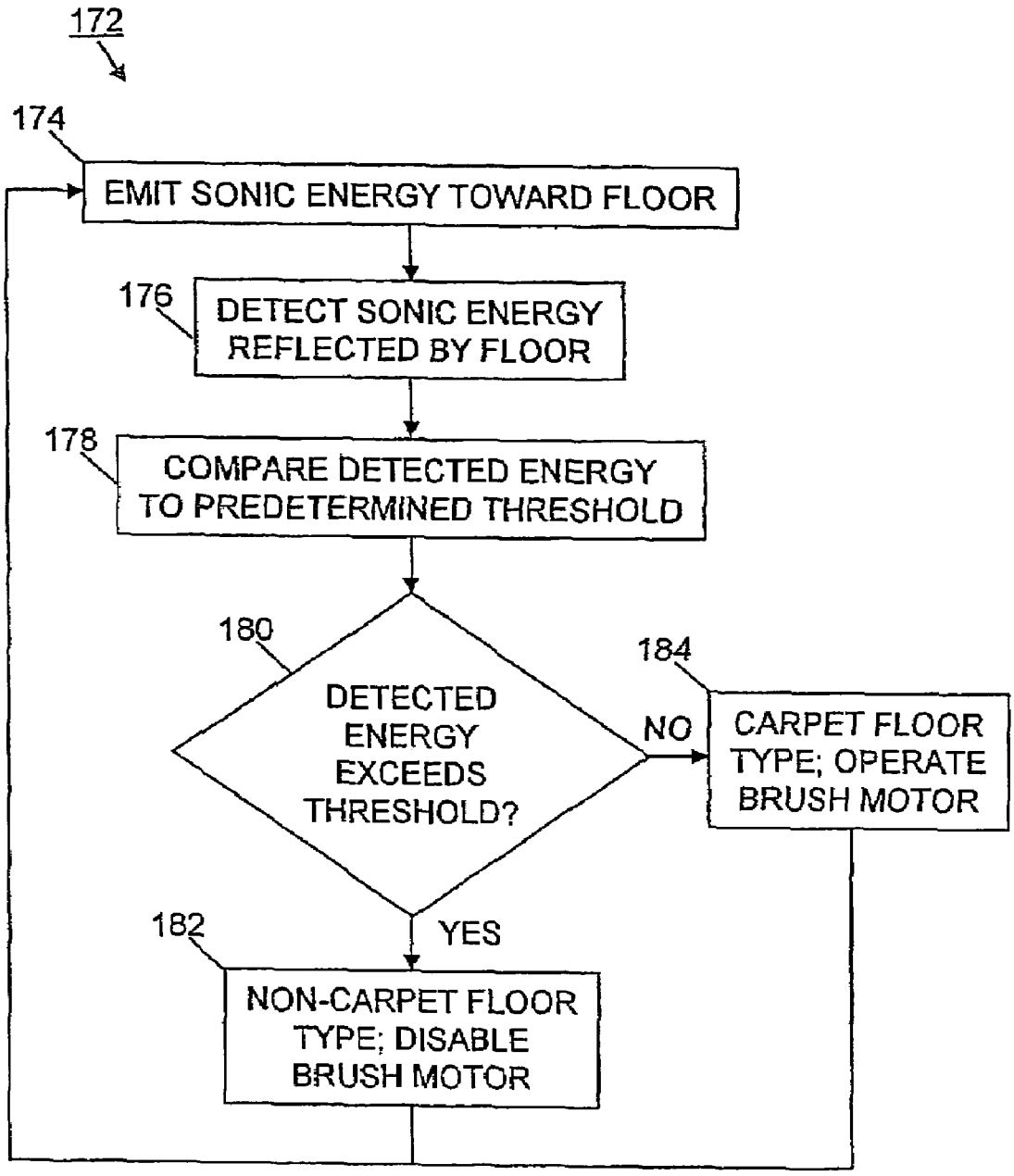
FIG. 10 is a flowchart of an embodiment of a floor type sensing and control process for a vacuum cleaner according to the present invention.

With reference to FIG. 10, a floor type sensing and control process 172 for a vacuum cleaner begins at step 174 when a floor type sensor emits sonic energy toward the floor. Next, at step 176, sonic energy reflected by the floor is detected by the floor type sensor. The detected sonic energy is compared to a predetermined threshold (step 178). At step 180, the process determines whether or not the detected sonic energy exceeds the predetermined threshold. If the detected sonic energy exceeds the predetermined threshold, the floor type is non-carpet or hard and the brush motor is disabled (step 182). Otherwise, the floor type is carpet or soft and the brush motor is operated (step 184). As shown, steps 174-184 are periodically repeated while power is applied to the vacuum cleaner. In an alternate embodiment, the detected sonic energy is compared to a plurality of values in an LUT, each LUT value representing a different type of floor. Depending on the type of floor detected, various predetermined control procedures are activated. For example, a given predetermined control procedure may include adjusting the speed of the brush motor associated with the vacuum cleaner to a preferred speed for that type of floor. Another example of a predetermined control procedure is where the vacuum cleaner is a carpet extractor and the control procedure includes selecting a preferred cleaning solution and/or dispensing a preferred quantity of cleaning solution based on the type of floor being traversed.

Figure 11:
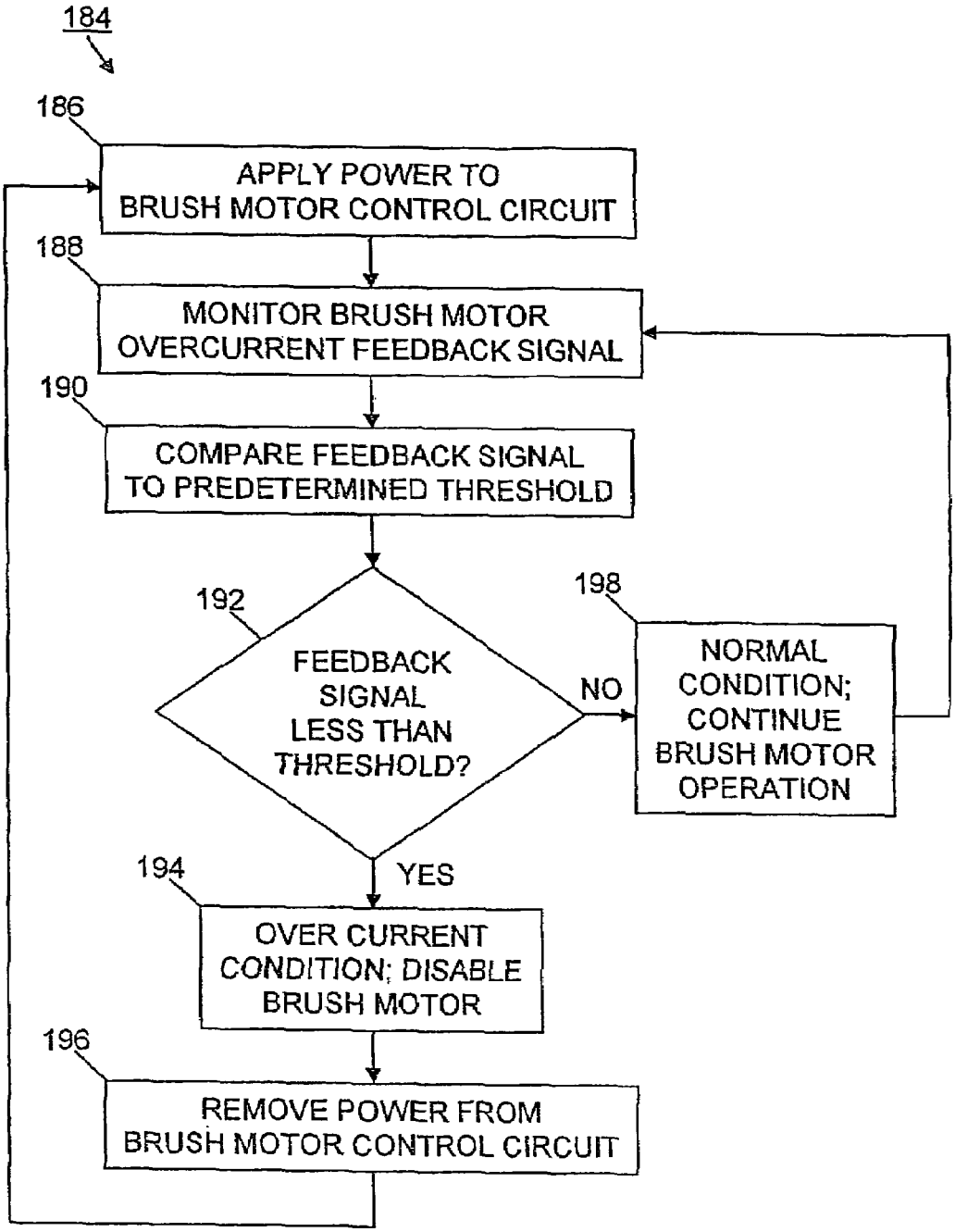
FIG. 11 is a flowchart of an embodiment of a brush motor current sensing and control process for a vacuum cleaner according to the present invention.

With reference to FIG. 11, a brush motor current sensing and control process 184 for a vacuum cleaner begins at step 186 when power is applied to a brush motor control circuit associated with the vacuum cleaner. At step 188, a brush motor overcurrent feedback signal is monitored by a sensor processor via a brush motor overcurrent sensor. The feedback signal, for example, may provide information associated with brush motor RPM, brush motor torque, quantity of brush motor revolutions, and/or distance of brush motor rotation. Next, at step 190, the feedback signal is compared to a predetermined threshold. At step 192, it is determined whether or not the feedback signal is less than the predetermined threshold. If the detected current is less than the threshold, an overcurrent condition exists and the brush motor is disabled (step 194). The brush motor remains disabled until step 196 where power is removed from the brush motor control circuit by some form of manual reset. For example, removing and re-applying power to power and control components associated with the brush motor would suffice as a reset. After the manual reset, the process starts over when power is applied to the brush motor control circuit in step 186.

If the feedback signal is not less than the predetermined threshold in step 192, a normal condition exists and the process advances to step 198. At step 198, brush motor operation continues and the process returns to step 188. Steps 188-198 are periodically repeated while power is applied to the brush motor. The predetermined threshold may provide overcurrent protection for short circuit conditions and/or overload conditions of the brush motor, including locked rotor conditions.

Figure 12:
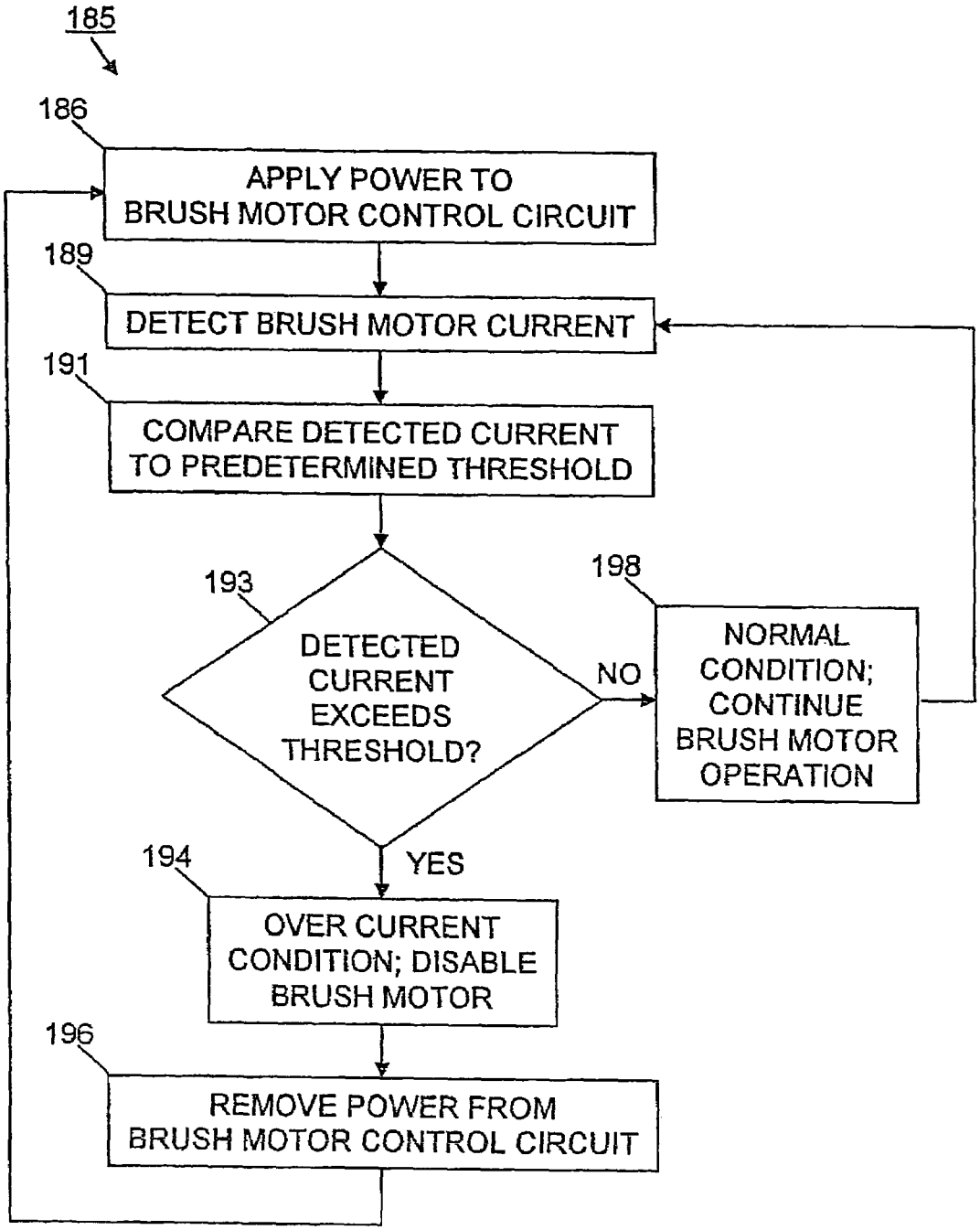
FIG. 12 is a flowchart of another embodiment of a brush motor current sensing and control process for a vacuum cleaner according to the present invention.

With reference to FIG. 12, another embodiment of a brush motor current sensing and control process 185 for a vacuum cleaner begins at step 186 when power is applied to a brush motor control circuit associated with the vacuum cleaner. At step 189, the brush motor current is detected by a brush motor overcurrent sensor. Next, at step 191, the detected brush motor current is compared to a predetermined threshold. At step 193, it is determined whether or not the detected brush motor current exceeds the predetermined threshold. If the detected current exceeds the threshold, an overcurrent condition exists and the brush motor is disabled (step 194). The brush motor remains disabled until step 196 where power is removed from the brush motor control circuit by some form of manual reset. For example, removing and re-applying power to power and control components associated with the brush motor would suffice as a reset. After the manual reset, the process starts over when power is applied to the brush motor control circuit in step 186.

If the detected brush motor current does not exceed the predetermined threshold in step 193, a normal condition exists and the process advances to step 198. At step 198, brush motor operation continues and the process returns to step 188. Steps 188-198 are periodically repeated while power is applied to the brush motor. The predetermined threshold may provide overcurrent protection for short circuit conditions and/or overload conditions of the brush motor, including locked rotor conditions.

Figure 13:
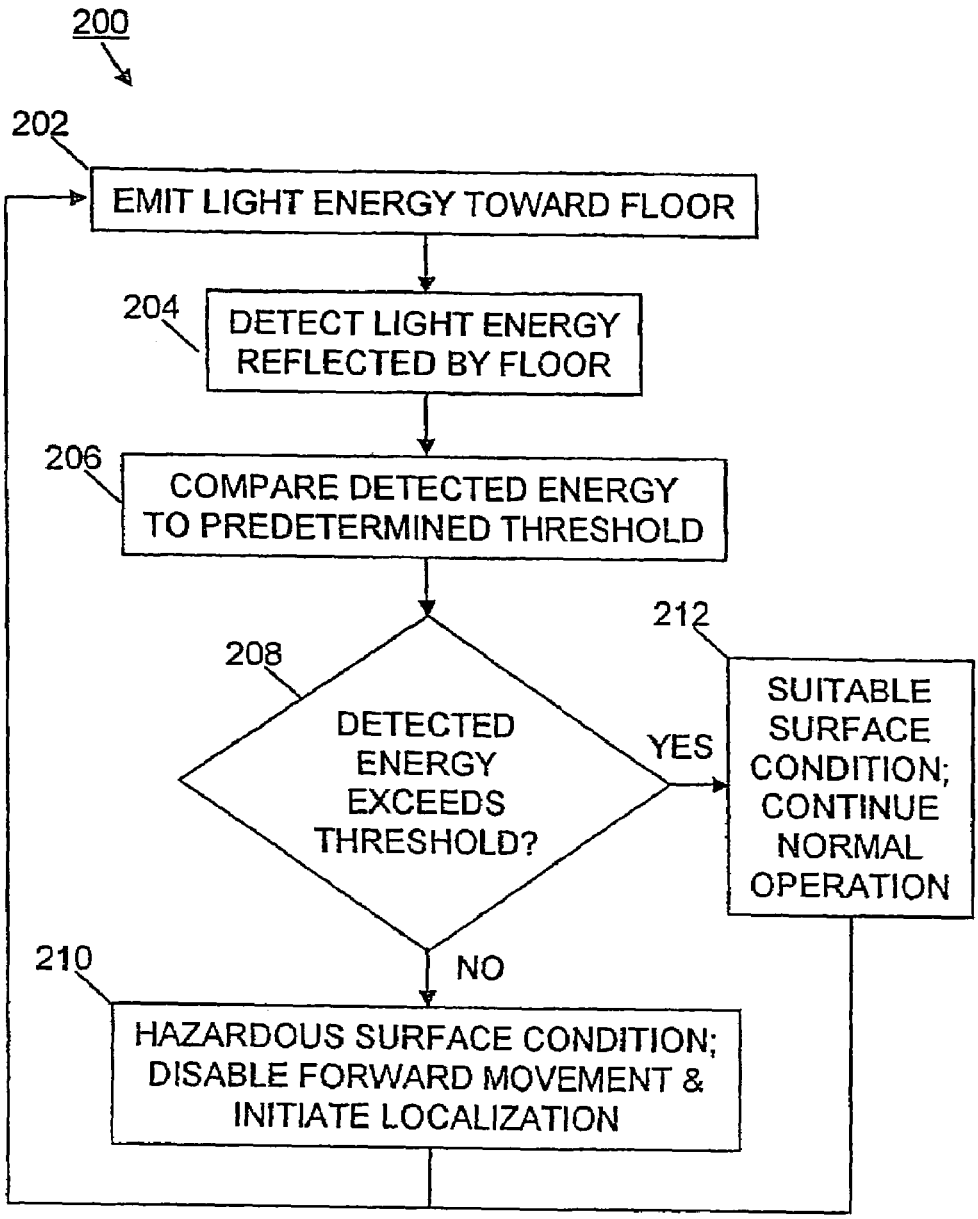
FIG. 13 is a flowchart of an embodiment of a floor loss sensing and control process for a vacuum cleaner according to the present invention.

With reference to FIG. 13, a floor distance sensing and control process 200 for a vacuum cleaner begins at step 202 when light energy is emitted toward a surface of a floor toward which the vacuum cleaner is advancing by a floor distance sensor. Next, at step 204, light energy reflected by the floor is detected by the floor distance sensor. At step 206, the detected light energy is compared to a predetermined threshold. Next, at step 208, the process determines whether the detected light energy exceeds the predetermined threshold. If the detected energy exceeds the threshold, a potential hazardous surface condition exists. Then, at step 210, forward movement of the vacuum cleaner is disabled and a localization routine is initiated. If the detected energy does not exceed the threshold, a suitable surface condition exists and normal operation is continued (step 212). The process continues with steps 202-212 being periodically repeated while the vacuum cleaner is being propelled.

In an alternate embodiment, when a potential hazardous surface condition exists, a predetermined control procedure to avoid the hazardous surface condition may be implemented. For example, the vacuum cleaner may implement an edge following routine where the floor distance sensor is used to avoid proceeding beyond the edge of the potentially hazardous surface condition.

Figure 14:
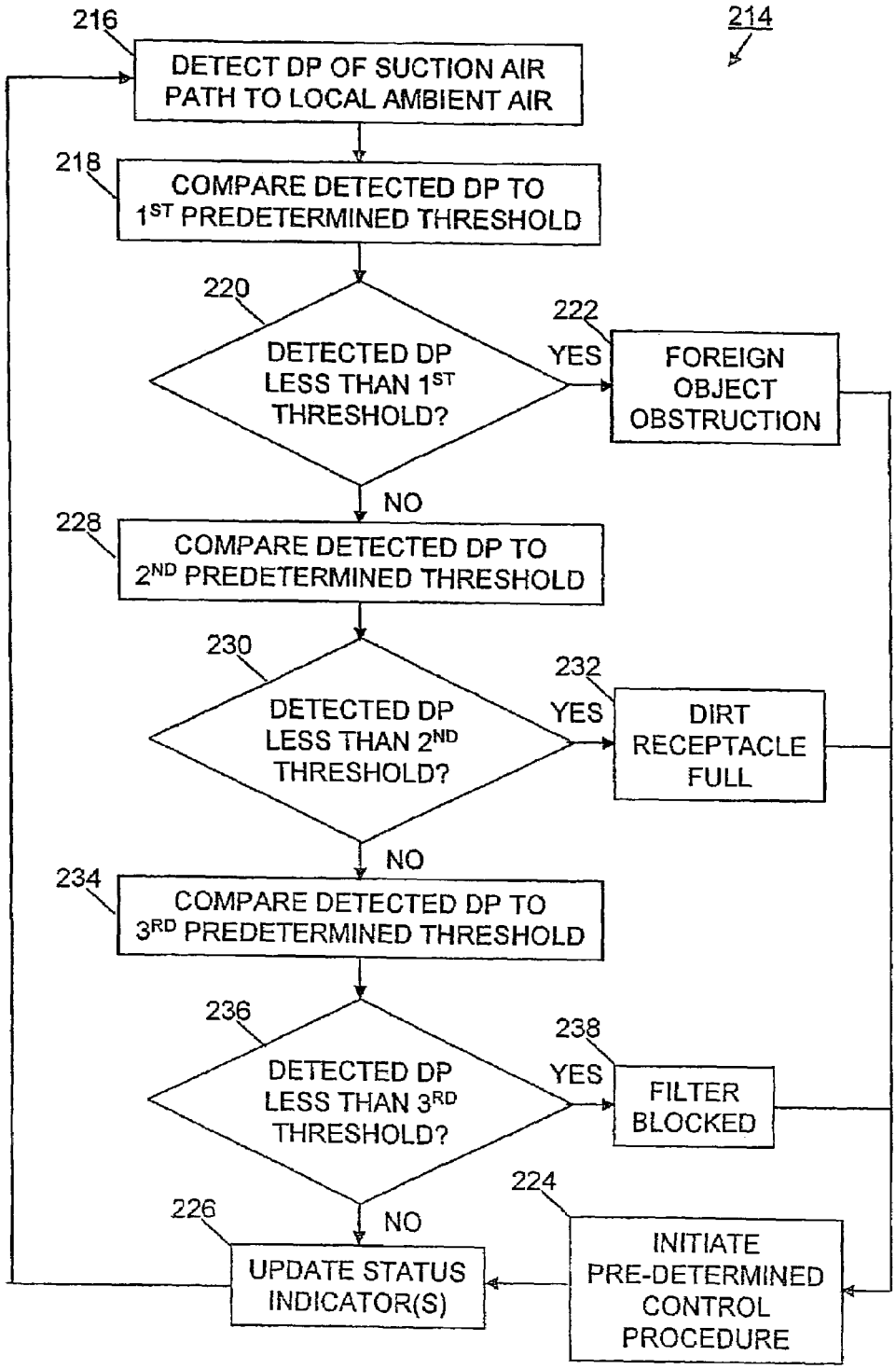
FIG. 14 is a flowchart of an embodiment of a suction airflow sensing and control process for a vacuum cleaner according to the present invention.

With reference to FIG. 14, a suction airflow sensing and control process 214 for a vacuum cleaner begins at step 216 when a differential pressure between a suction airflow path associated with the vacuum cleaner and ambient air near the vacuum cleaner is detected by a suction airflow sensor. At step 218, the detected differential pressure is compared to a first predetermined threshold. At step 220, the process determines whether the detected differential pressure is less than the first predetermined threshold. If the detected pressure is less than the threshold there is a foreign object obstruction in the suction airflow path (step 222). For example, a sock may have been sucked into the suction inlet. Next, a predetermined control procedure is initiated (step 224). For example, the suction motor may be stopped. If the vacuum cleaner includes a brush, the brush motor may also be stopped. Similarly, if the vacuum cleaner is self-propelled and currently moving, the drive motor may also be stopped.

Next, at step 226, status indicators reflecting the condition of the suction airflow path are updated. For example, a display may be illuminated in red and/or an annunciator may sound a unique audible tone sequence associated with a foreign object obstruction.

At step 220, if the detected differential pressure is not less than the threshold, the process advances to step 228 where the detected differential pressure is compared to a second predetermined threshold. Next, at step 230, the process determines whether the detected differential pressure is less than the second threshold. If the detected differential pressure is less than the second threshold, the dirt receptacle associated with the vacuum cleaner is generally full (step 232). In other words, the dirt cup for a bagless system needs to be emptied or the bag for a bag system needs to be removed and replaced. The process continues to step 224 and initiates a predetermined control procedure associated with the dirt receptacle being generally full. Next, the status indicator is updated (step 226). For example, a yellow illuminated display is lit and/or a unique audible tone sequence is sounded.

At step 230, if the detected differential pressure is not less than the second threshold, the process advances to step 234 and the detected differential pressure is compared to a third predetermined threshold. Next, at step 236, the process determines whether the detected differential pressure is less than the third threshold. If the detected differential pressure is less than the third threshold, a filter associated with the vacuum cleaner is generally blocked (step 238). Next, at step 224, a predetermined control procedure associated with conditions when the filter is generally blocked is initiated. At step 226, the status indicator is updated to reflect the blocked filter condition. For example, the illuminated display flashes yellow and/or a unique audible tone sequence associated with the blocked filter condition is sounded.

At step 236, if the detected differential pressure is not less than the third threshold, the section airflow path is suitable for normal vacuuming operations and the process continues to step 226 where the status indicator is updated. For example, a green illuminated display is lit.

Steps 216-238 are periodically repeated while power is applied to the suction motor. While the process described identifies three predetermined thresholds associated with three unique conditions, other embodiments may include more or less thresholds and associated conditions.

Figure 15:
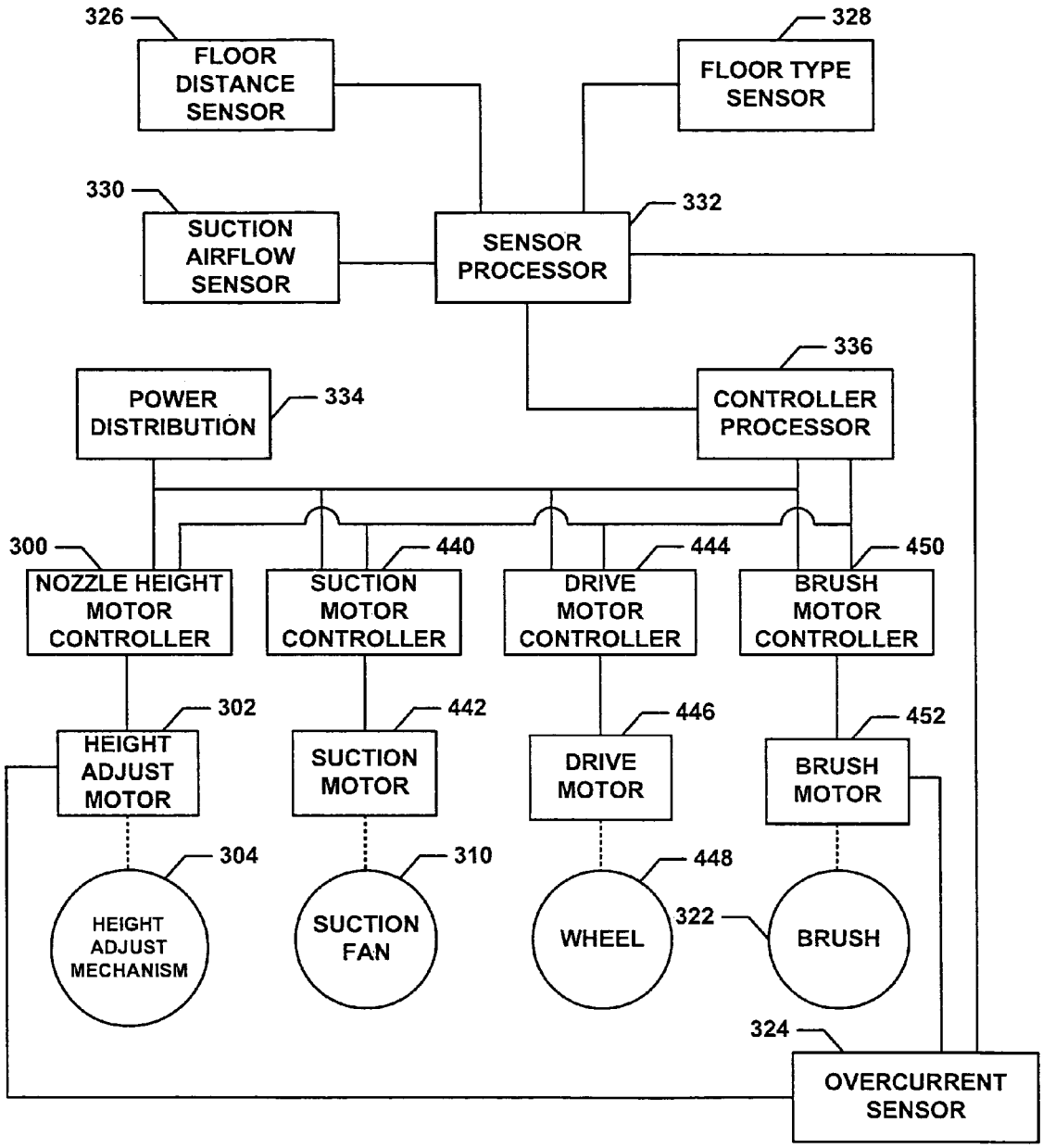
FIG. 15 is a functional block diagram of an embodiment of a vacuum cleaner according to one aspect of the present invention.

With reference to FIG. 15, an embodiment of an upright vacuum cleaner includes a suction motor 442, a suction fan 310, a wheel 448, a brush 322, a controller processor 336, a power distribution 334, a sensor processor 332, a suction airflow sensor 330, a floor distance sensor 326, a floor type sensor 328, a brush motor overcurrent sensor 324, a brush motor 452, a drive motor 446, a brush motor controller 450, a drive motor controller 444, and a suction motor controller 440, as described in connection with the embodiment of FIG. 3 above. In addition, this embodiment of the upright vacuum cleaner further includes a height adjust means which comprises a nozzle height motor controller 300, a height adjust motor 302 and a height adjust mechanism 304.

Figure 21:
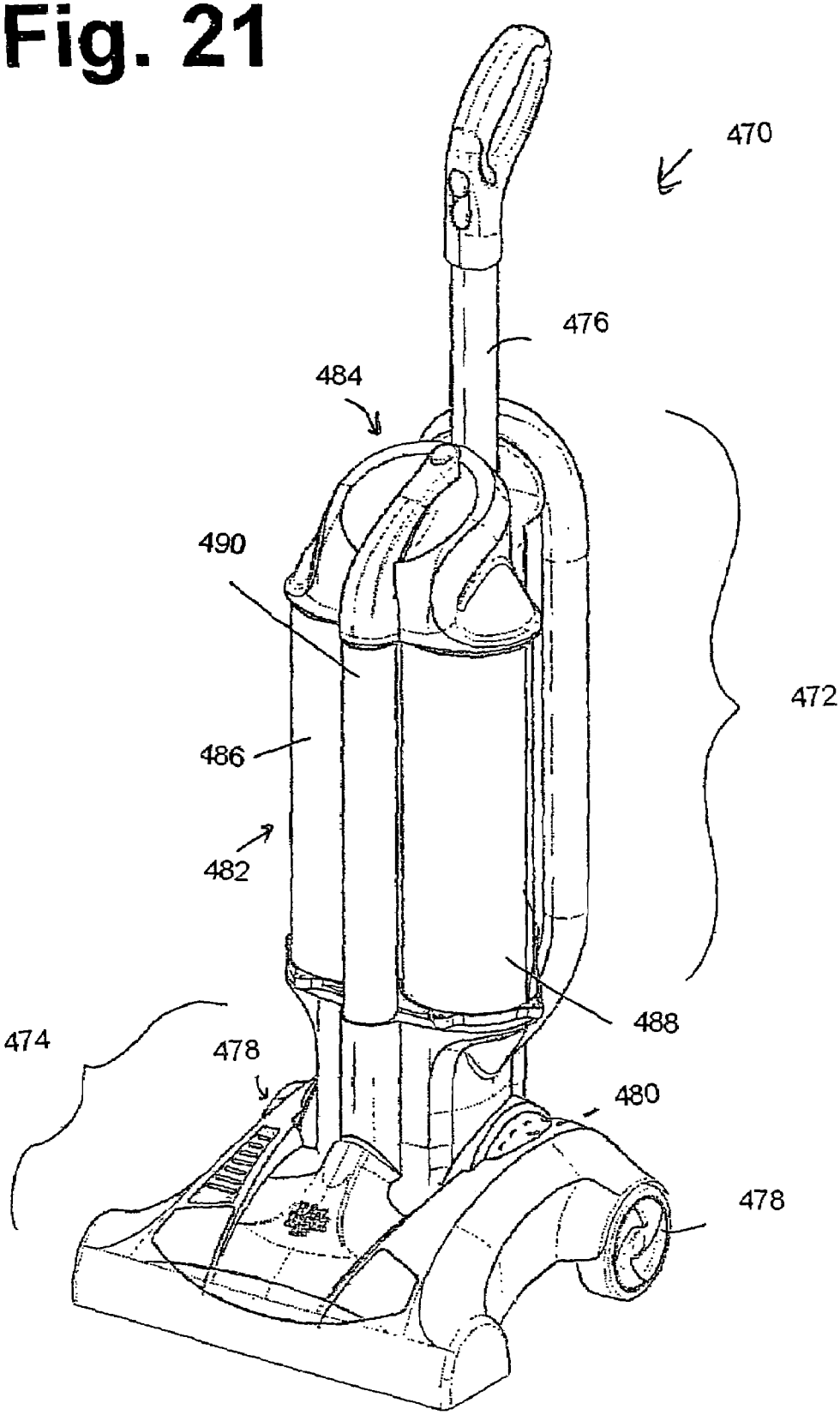
FIG. 21 is a perspective view of a bagless upright vacuum cleaner according to one aspect of the present invention.

Power distribution 334 receives power from a power source and distributes power to other components of an upright vacuum cleaner including the height adjust mechanism nozzle height motor controller 300. With reference to FIG. 21, the power source, for example, may be located in an upright housing section 472 or in a cleaning head or nozzle base 474 of an upright vacuum cleaner. Also, it can be divided between both the housing 472 and the cleaning head or nozzle base 474. The controller processor 336 can control the height adjust mechanism 304 via the nozzle height motor controller 300. Alternatively, the controller processor 336 can control the height adjust motor 302 directly or via substantially any type of suitable control device.

In addition, the floor type sensor 328 and the floor distance sensor 326 individually or in combination, can provide feedback to the sensor processor 332 to control the height of the vacuum cleaner height adjust mechanism 304. The controller processor 336 can provide information to the nozzle height motor controller 300 to determine whether to drive the height adjust motor 302. For instance, if the floor type sensor 328 determines that the floor has a low profile (e.g., low pile carpet, etc.), the height adjust motor 302 can lower the height adjust mechanism 304 to accommodate such a profile. In this manner, the height adjust mechanism 304 can be located at an ideal distance from the floor to provide efficient cleaning.

In another example, height adjustment can be done automatically based on feedback from the floor distance 326 sensor, which indicates the distance of the floor relative to an adjacent surface of the vacuum cleaner. Such information can be compared with one or more predetermined values, for example, wherein the nozzle height motor controller 300 can direct the height adjust motor 302 to raise or lower the height adjust mechanism 304 accordingly.

Adjustment of the height of the height adjust mechanism can be varied based on an event, such as a user command from a handle of an upright vacuum cleaner. In addition or alternatively, a micro-switch (not shown) in a pivot of an upright vacuum cleaner can act as an input to the controller processor. For example, when the handle of an upright vacuum cleaner is in a particular position (e.g., upright), the micro-switch can input a signal to the controller processor 336 to change the position of the height adjust mechanism 304 relative to the floor, e.g., raising a nozzle opening away from the floor.

In order to determine the appropriate height for the height adjust mechanism, an artificial intelligence (AI) component (not shown) can be employed. In one aspect, the AI component can employ information received from one or more sources (e.g., floor distance sensor 326, floor type sensor 328, user command, etc.) to determine the appropriate height. In one aspect of the subject invention, the appropriate height can be determined by machine learning wherein one or more training sets of data with examples of desired results and/or undesired results for data format and/or processing techniques can be utilized to train the system. In another aspect, desired results can be inferred, based on one or more initial conditions. Such initial conditions can be adjusted over time and in response to user actions associated with returned results in order to improve discrimination.

As utilized herein, the term "inference" refers generally to the process of reasoning about or inferring states of the system, environment, and/or user from a set of observations as captured via events and/or data. Inference can be employed to identify a specific context or action, or can generate a probability distribution over states, for example. Inference can refer to techniques employed for composing higher-level events from a set of events and/or data. Various classification schemes and/or systems (e.g., support vector machines, neural networks (e.g., back-propagation, feed forward back propagation, radial bases and fuzzy logic), expert systems, Bayesian networks, and data fusion) can be employed in connection with performing automatic and/or inferred action in connection with the subject invention.

The vacuum cleaner can employ a memory (not shown) that stores a value representative of a particular position whenever the height is adjusted. The memory can contain corresponding values from one or more disparate sensors (e.g., floor distance sensor 326, floor type sensor 328, etc.) and store such disparate values with the height adjustment value. In addition, the last height position can be retained upon power down of the vacuum. When power is subsequently applied, the height setting can return to the last stored height value.

In one example, the height adjust motor 302 speed and direction can be controlled by an H-bridge whose inputs are controlled by the nozzle height motor controller 300. Speed of the height adjust motor 302 can be accomplished via pulse width modulation to the H-bridge. Alternatively or in addition, a linear potentiometer can be connected to the output shaft of the gear box. This potentiometer can provide a value which is directly proportional to the height setting. This signal can be sent to an analog-to-digital (A to D) converter in the nozzle height motor controller 300. This A to D value can provide data for the height setting and appropriate lighting of one or more LEDs, which can serve to indicate the height of the unit's nozzle opening or suction inlet.

The floor type sensor 328, in combination with the sensor processor 332, detects the type of floor being traversed and distinguishes between and within carpeted and non-carpeted surfaces. Floor type information can be communicated to the controller processor 336. In turn, the controller processor 336 can provide one or more values from the floor distance sensor 326 and/or the floor type sensor 328 to the nozzle height motor controller 300. In one embodiment, the nozzle height motor controller 300 is an H-bridge whose inputs are controlled via the controller processor 336. Speed of the height adjust motor 302 can be accomplished by applying a pulse width modulated signal to the H-bridge. In this manner, the height adjust motor 302 can drive the height adjust mechanism 304 until it is in a desired location.

Figure 16:
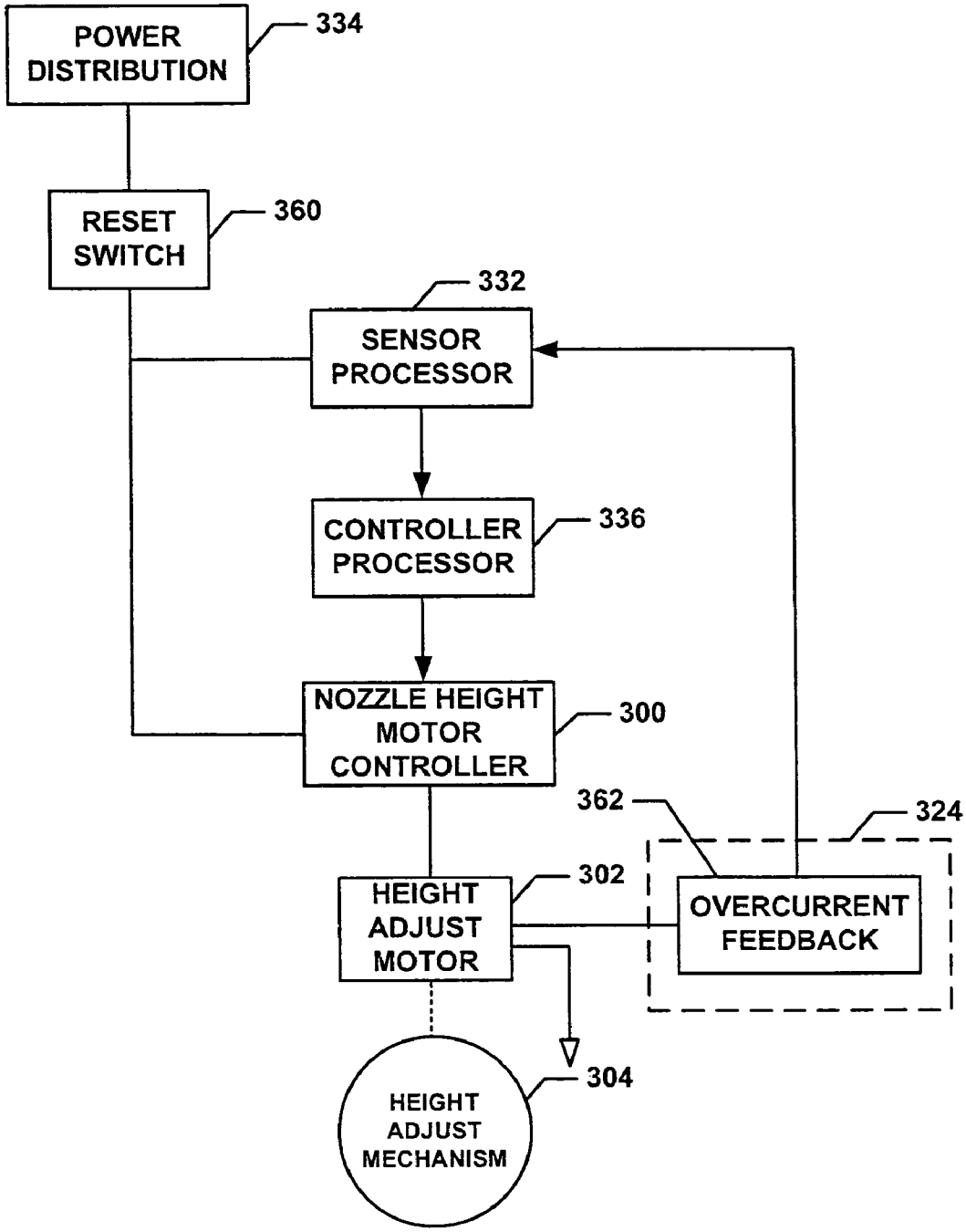
FIG. 16 is a functional block diagram of an embodiment of a height adjust motor current sensing and control circuit according to one aspect of the present invention.

With reference to FIG. 16, a vacuum cleaner circuit with a motor overcurrent sensor 324 also includes the height adjust mechanism 304, the controller processor 336, the power distribution 334, the sensor processor 332, the height adjust motor 302, the nozzle height motor controller 300 and a reset switch 360. The overcurrent sensor 324 can include an overcurrent feedback module 362, which can provide information associated with height adjust motor 302, such as RPM, motor torque, quantity of motor revolutions, and/or distance of motor rotation. The overcurrent feedback module 362 can include, for example, encoders that provide information associated with the quantity of height adjust motor 302 revolutions from a given point and/or the distance of height adjust motor rotation from a given point.

The overcurrent sensor 324 can provide electronic current protection for the height adjust motor 302. If a predetermined current level is exceeded, the nozzle height motor controller 300 can shut down the height adjust motor 302 via the sensor processor 332 and the controller processor 336. In one embodiment, a power cycle can be required to reset this condition. In another approach, the reset switch 360 can be activated prior to reapplying power to the height adjust motor 302. If the predetermined current level is exceeded, an LED (not shown) or other indicator can be illuminated to notify a user.

During operation of the height adjust motor 302, power flows from power distribution 334 through the reset switch 360 and the nozzle height motor controller 300 to the height adjust motor 302. In the embodiment being described, the return path for power is connected to the height adjust motor 302. In one approach, the sensor processor 332 can monitor the RPM of the height adjust motor 302 via the overcurrent feedback module 362 and determine whether an overcurrent condition exists based on the height adjust motor RPM.

The sensor processor 332 may, alternatively, monitor the torque of the height adjust motor 302, the revolutions thereof, and/or the distance of motor rotation. The sensor processor 332 can compare the information provided by the overcurrent feedback module 362 to a predetermined threshold. If the feedback information is less than the predetermined threshold, the sensor processor 332 can send a control signal to the controller processor 336 and/or the nozzle height motor controller 300 to open the power connection to the height adjust motor 302. In the embodiment being described, the nozzle height motor controller 300 remains open until the reset switch 360 is manually activated, thereby cycling power to the nozzle height motor controller 300 and applying a control activation signal to the sensor processor 332. In other embodiments, the nozzle height motor controller 300 can be reset by other suitable means. Once power is cycled by activation of the reset switch 360, the sensor processor 332 sends a control signal to close the power connection in the nozzle height motor controller 300, thus enabling power to flow to the height adjust motor 302 through the nozzle height motor controller 300.

The sensor processor 332 can communicate conditions associated with the height adjust motor 302 current to the controller processor 336. In turn, the controller processor 336 can utilize height adjust motor 302 current information to control the operation of the height adjust motor, including on/off and/or speed control. The nozzle height motor controller 300, height adjust motor 302, and height adjust mechanism 304 can operate in the same manner as described above in reference to FIG. 3.

It should be appreciated that the vacuum cleaner circuit with the height adjust motor overcurrent sensor 324, and the other embodiments disclosed herein, can be implemented in a variety of units. These include a robotic vacuum cleaner, a robotic canister-like vacuum cleaner, a hand vacuum cleaner, a carpet extractor, a canister vacuum cleaner, an upright vacuum cleaner, and similar household cleaning appliances that include a height adjust motor.

Figure 17:
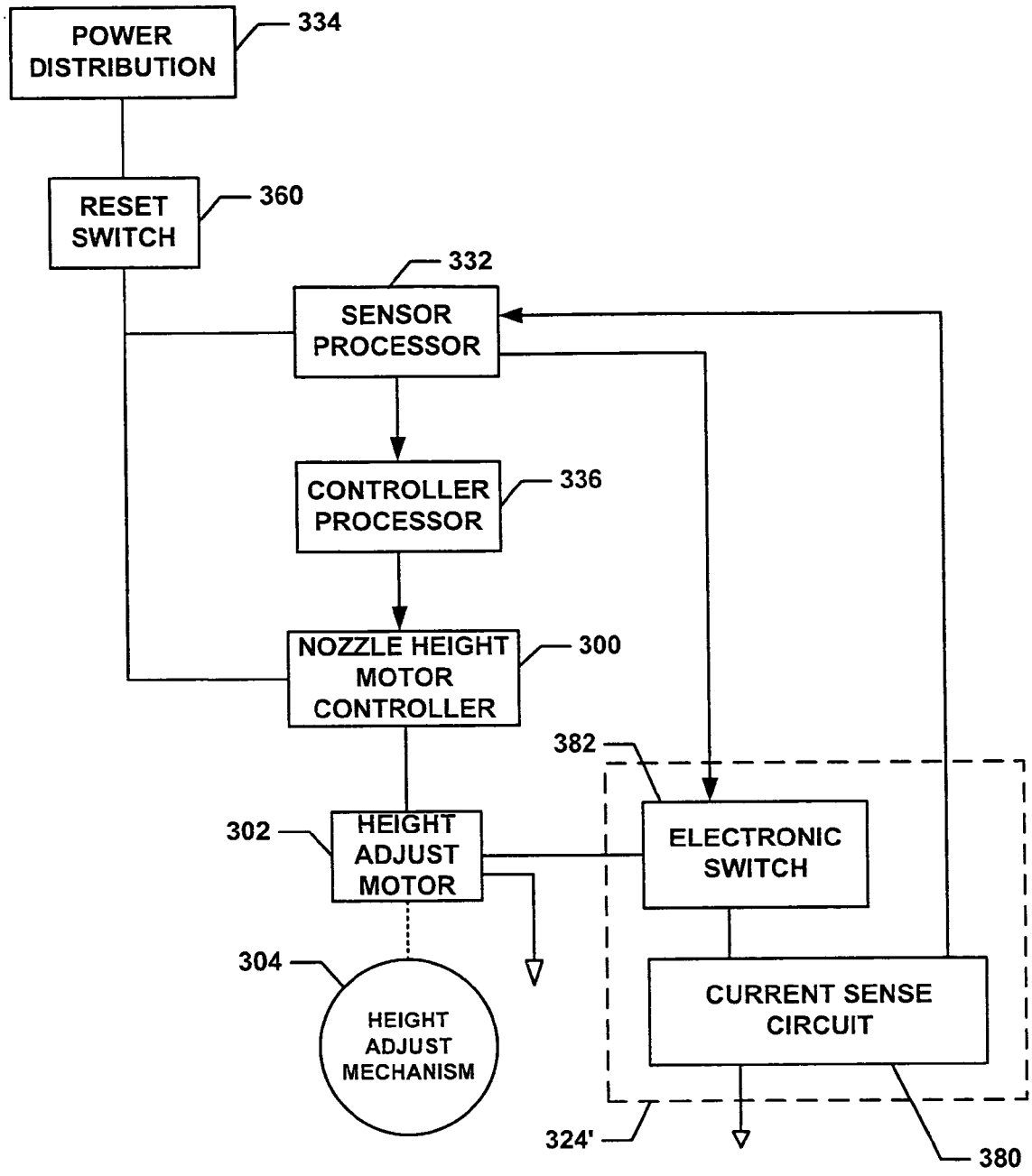
FIG. 17 is a functional block diagram of an alternative embodiment of a height adjust motor current sensing and control circuit according to one aspect of the present invention.

With reference to FIG. 17, another embodiment of a vacuum cleaner circuit with a motor overcurrent sensor 324' includes the height adjust mechanism 304, the controller processor 336, the power distribution 334, the sensor processor 332, the height adjust motor 302, the nozzle height motor controller 300 and the reset switch 360. In one example, the overcurrent sensor 324' includes a current sense circuit 380 and an electronic switch 382.

During operation of the height adjust motor 302, power flows from power distribution 334 through the reset switch 360 and the nozzle height motor controller 300 to the height adjust motor 302. In one example, the overcurrent sensor 324' can be in the return path between the height adjust motor 302 and ground. In other embodiments, the overcurrent sensor 324' can be located at other points in the height adjust motor 302 current path.

The sensor processor 332 can monitor height adjust motor 302 current via the current sense circuit 380. This circuit may include a current sense resistor that converts motor current to a voltage signal that is filtered and provided to the sensor processor 332. The sensor processor 332 can compare the sensed current to a predetermined threshold. If the sensed current exceeds the predetermined threshold, the sensor processor 332 can send a control signal to the electronic switch 382 to open the return path for power to the height adjust motor 302.

In one embodiment, the electronic switch 382 remains open until the reset switch 360 is manually activated, thereby cycling power to the nozzle height motor controller 300 and applying a control activation signal to the sensor processor 332. In other embodiments, the electronic switch 382 may be reset by other suitable means. Once power is cycled by activation of the reset switch 360, the sensor processor 332 sends a control signal to close the electronic switch 382, thus enabling power to flow through the height adjust motor 302 via the nozzle height motor controller 300 under control of the controller processor 336 and sensor processor 332.

The sensor processor 332 can communicate conditions associated with height adjust motor 302 current to the controller processor 336. In turn, the controller processor 336 can utilize height adjust motor 302 current information to control operation of the height adjust motor 302, including on/off and/or speed control. The nozzle height motor controller 300, height adjust motor 302, and height adjust mechanism 304 can operate in the same manner as described above in reference to FIG. 3.

Figure 18:
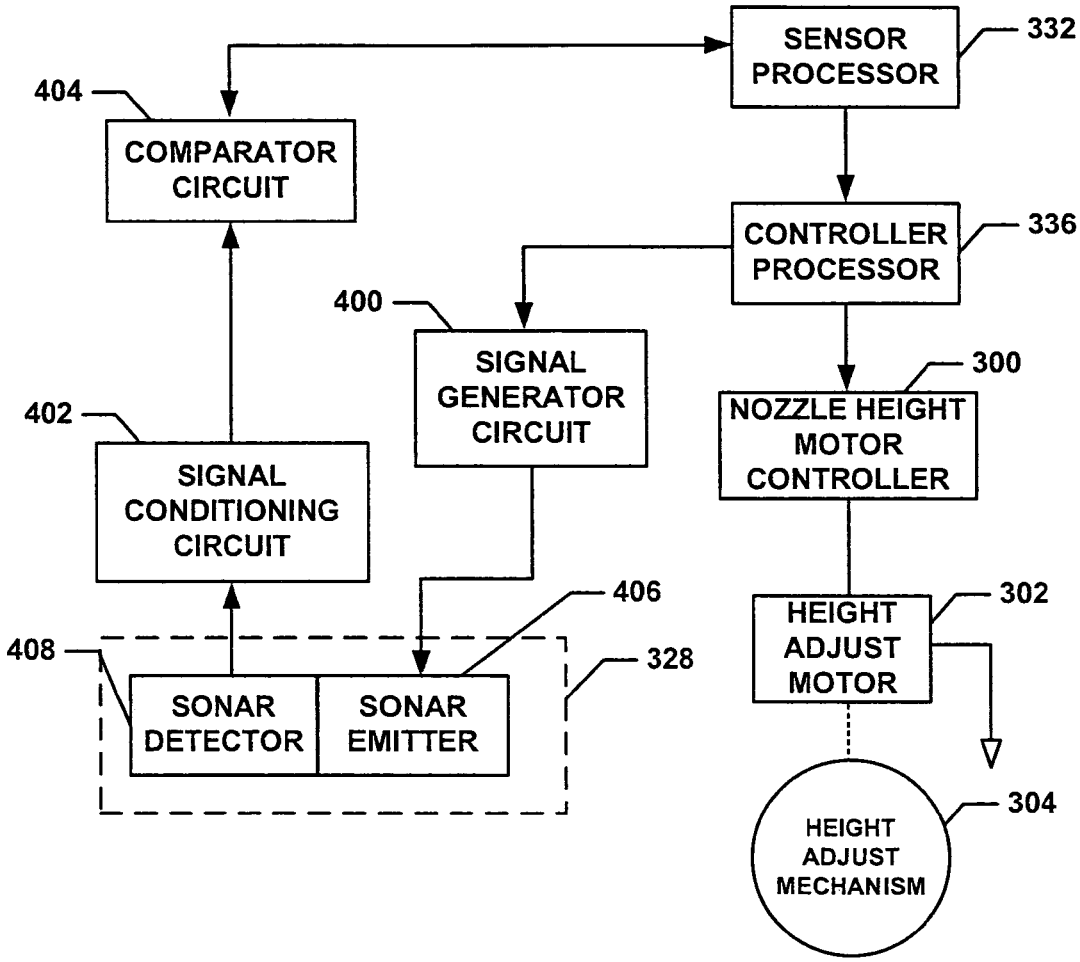
FIG. 18 is a functional block diagram of a height adjust motor height control circuit that employs a floor type sensor according to one aspect of the present invention.

With reference to FIG. 18, a vacuum cleaner circuit with a floor type sensor 328 can also include the height adjust mechanism 304, the controller processor 336, the sensor processor 332, the height adjust motor 302, the nozzle height motor controller 300, a signal generator circuit 400, a signal conditioning circuit 402, and a comparator circuit 404. In one embodiment, the floor type sensor 328 is based on sonar technology and includes a sonar emitter 406 and a sonar detector 408.

In this embodiment, the sensor processor 332 can communicate a control signal to the signal generator circuit 400. In turn, the signal generator circuit 400 can provide a drive signal to the sonar emitter 406. In one example, the control and drive signals can be about 416 KHz. Typically, the drive signal is a high voltage stimulus that causes the sonar emitter 406 to emit sonic energy in the direction of the floor to be sensed. Such energy is either reflected (in the case of a hard floor) or partially absorbed and scattered (in the case of a soft or carpeted floor). The reflected sonic energy is received by the sonar detector 408 and converted to an electrical signal provided to the signal conditioning circuit 402. In turn, the signal conditioning circuit 402 conditions and filters the detected signal so that it is compatible with the comparator circuit 404. If desired, the comparator circuit 404 can be programmable and can receive a second input from the sensor processor 332. The input from the sensor processor 332 can act as a threshold for comparison to the detected signal. One or more predetermined threshold values may be stored in the sensor processor 332 and individually provided to the comparator circuit 404. The output of the comparator circuit 404 can be monitored by the sensor processor 332.

The comparator circuit 404 can be implemented by hardware or software. For example, in one embodiment the sensor processor 332 may include a look-up table (LUT) and a comparison process may include matching the detected signal to values in the look-up table where values in the look-up table identify thresholds for the detected signal for various types of floor surfaces. For example, hard floor surfaces, such as concrete, laminate, ceramic, and wood, and soft floor surfaces, such as sculptured carpet, low pile carpet, cut pile carpet, and high pile carpet.

The sensor processor 332 can identify the type of floor being traversed by the vacuum cleaner and communicate the type of floor information to the controller processor 336. Based on the type of floor information, the controller processor 336 can determine the appropriate height adjust mechanism height based on one or more factors, such as providing optimum cleaning, avoid damage to the vacuum cleaner, etc. A control signal is provided to the nozzle height motor controller 300 to drive the height adjust motor 302 in the appropriate direction. The controller processor 336 can also control the speed of the height adjust motor 302 via the nozzle height motor controller 300, if variations in height adjust mechanism 304 height, based on the type of floor detected, are desirable.

The nozzle height motor controller 300, height adjust motor 302, and height adjust mechanism 304 can operate as described above in relation to FIG. 3. In an alternate embodiment, the nozzle height motor controller 300 may not be required and either the controller processor 336 or the sensor processor 332 can directly control the height adjust motor 302. In still another embodiment, the sensor processor 332 can directly control the nozzle height motor controller 300.

The vacuum cleaner circuit with the floor type sensor 328 which has been described above, can be implemented in a variety of units. These can include a robotic vacuum cleaner, a robotic canister-like vacuum cleaner, a hand vacuum cleaner, a carpet extractor, a canister vacuum cleaner, an upright vacuum cleaner, and similar indoor cleaning appliances (e.g., floor scrubbers) and outdoor cleaning appliances (e.g., street sweepers) that include one or more height adjust mechanisms.

Figure 19:
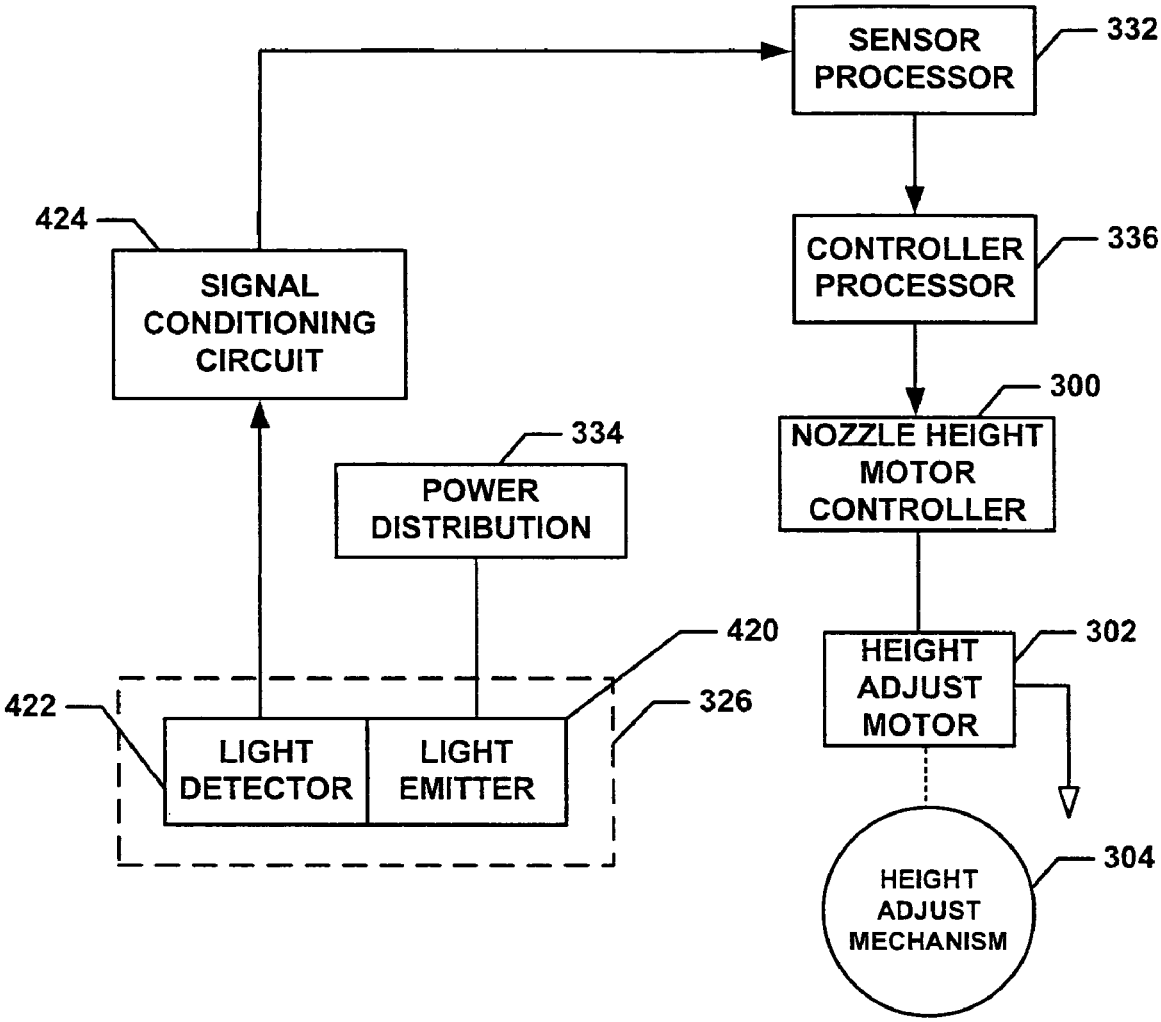
FIG. 19 is a functional block diagram of a height adjust motor height control circuit that employs a floor distance sensor according to one aspect of the present invention.

In reference to FIG. 19, a vacuum cleaner circuit with the floor distance sensor 326 also includes the height adjust mechanism 304, the controller processor 336, the power distribution 334, the sensor processor 332, the height adjust motor 302, the nozzle height motor controller 300 and the signal conditioning circuit 424. In one embodiment, the floor distance sensor can include a light emitter 420 and a light detector 422.

The power distribution 334 applies power to the light emitter 420. The light emitter 420 emits light energy toward a surface of a floor toward which the vacuum cleaner is advancing. The light detector 422 detects the amount of light reflected by the floor, which is indicative of the distance to the surface of the floor. A signal conditioning circuit 424 provides a detected signal to the light detector 422 and conditions and filters the signal for the sensor processor 332.

The sensor processor 332 compares the conditioned signal to a predetermined threshold to determine if there is a change in floor distance, such as when the vacuum cleaner approaches the edge of a downward staircase, a change in floor surface is encountered, etc. The specific values of this distance threshold can be programmable and dependent on sensor mounting and view angles. In one example, two floor distance sensors 326 can be mounted on opposite edges of the vacuum cleaner to detect a change in floor surface when the vacuum cleaner is moving at any angle.

The sensor processor 332 can identify conditions in the floor surface that may be hazardous and/or provide deleterious effects to the effectiveness of the height adjust mechanism for a self-propelled vacuum cleaner. In one example, a sudden change in floor distance (e.g., when moving from hardwood to shag carpeting) can require a change in nozzle height. Such changes in distance can be communicated to the controller processor 336. The controller processor 336 can control the nozzle height motor controller 300, which in turn controls the speed and direction of the height adjust motor 302 so that the height adjust mechanism 304 can be moved accordingly. If desired, the nozzle height motor controller 300, height adjust motor 302, and height adjust mechanism 304 can operate in the same manner as described above in reference to FIG. 3. Likewise, as described above, multiple height adjust motors 302 and height adjust mechanisms 304 can be implemented and independently controlled to provide optimum and efficient cleaning.

The vacuum cleaner circuit with the floor distance sensor 326 may be implemented in a variety of units. These include a robotic vacuum cleaner, a robotic canister-like vacuum cleaner, a self-propelled carpet extractor, a self-propelled canister vacuum cleaner, a self-propelled upright vacuum cleaner, and similar cleaning units (e.g., street sweeper, lawn mower, floor polisher) that employ one or more height adjust mechanisms.

Figure 20:
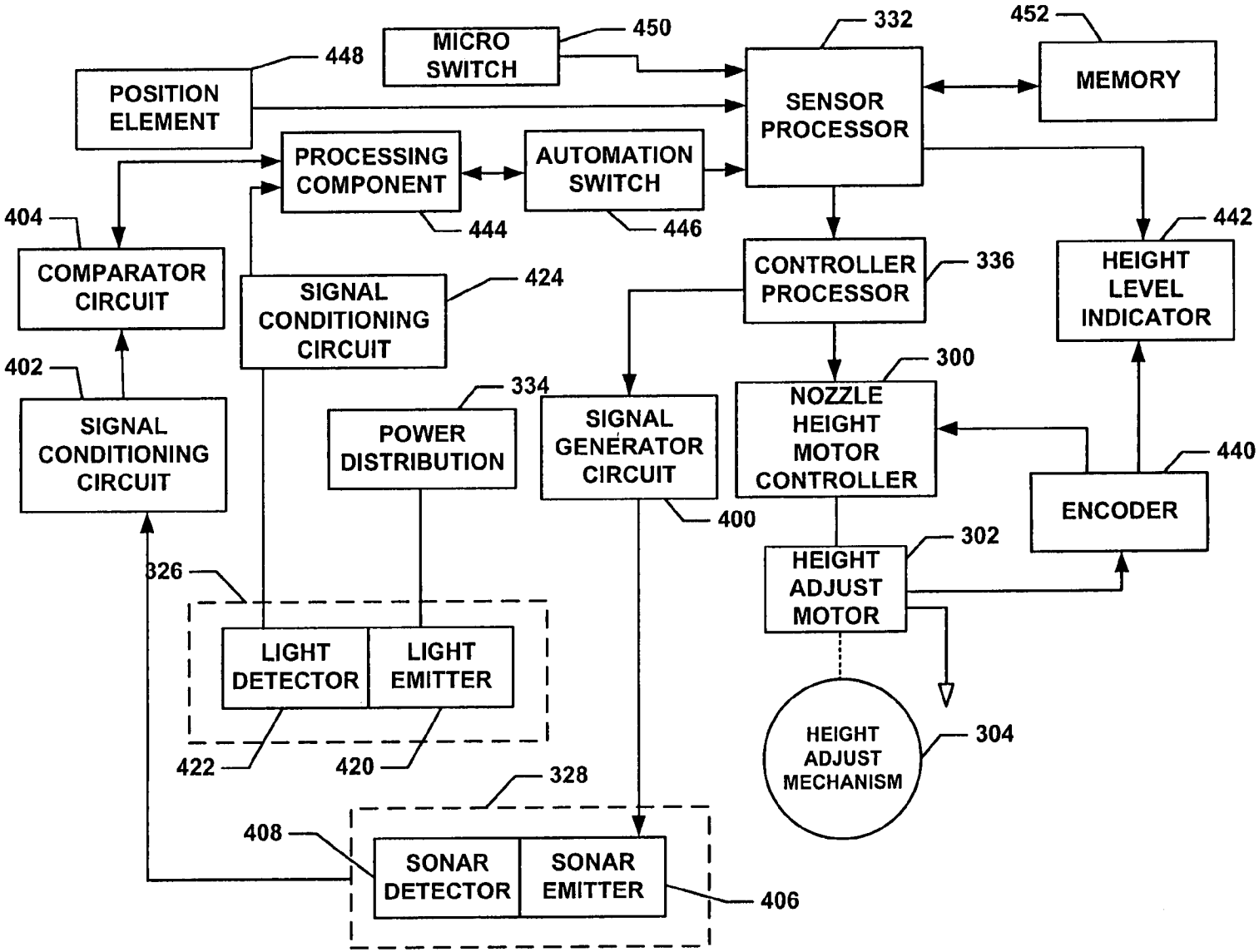
FIG. 20 is a functional block diagram of a height adjust motor height control circuit according to one aspect of the present invention.

FIG. 20 illustrates an embodiment of a nozzle height adjust system which includes the height adjust mechanism 304, the floor distance sensor 326, the floor type sensor 328, the sensor processor 332, the controller processor 336, the height adjust mechanism height motor controller 300, and the height adjust motor 302. The floor distance sensor 326 includes the light emitter 420, the light detector 422, the power distribution 334 and the signal conditioning circuit 424. The floor type sensor 328 further includes the sonar emitter 406, the sonar detector 408, the signal conditioning circuit 402, and the comparator circuit 404.

A processing component 444 receives data from the floor distance sensor 326 and the floor type sensor 328 via the signal conditioning circuit 424 and the comparator circuit 404 respectively. The processing component 444 can be a processor, computer, ASIC, algorithm, etc. that receives, stores, edits and/or retrieves one or more inputs and runs one or more programs to determine an ideal height adjust mechanism 304 height for the vacuum cleaner. Such inputs can include floor type, floor distance, suction motor speed, drive motor speed, brush motor speed, etc.

An automation switch 446 can be activated to allow the sensor processor 332 to receive data from at least one of the floor distance sensor 326 and the floor type sensor 328. In turn, data from the processing component 444 can be communicated to the sensor processor to control movement of the height adjust mechanism 304 via the controller processor 336, nozzle height motor controller 300, and height adjust motor 302. In another embodiment, the sensor processor 332 can communicate directly with the height adjust motor 302 to control the height adjust mechanism 304.

In one approach, the automation switch 446 can be a single pole, double throw switch located in the handle of an upright vacuum cleaner wherein a user can activate an automatic mode to determine the ideal height of the nozzle based on one or more conditions. Once the automatic mode is activated, the movement of the height adjust mechanism 304 can be dynamically adjusted to accommodate environmental changes (floor type, floor distance, etc.) encountered by the vacuum cleaner. In this manner, the ideal nozzle height can be maintained to provide optimum cleaning regardless of the surface encountered by the vacuum cleaner.

A position element 448 can be employed by a user to manually adjust the height of the height adjust mechanism 304 in the vacuum cleaner. Such manual adjustment can be accomplished in place of the automatic height adjustment (e.g., via automation switch 446) described above or as a temporary override to briefly locate the position of the height adjust mechanism 304. The position element 448 can be a slider, dial, knob, software interface, etc. that allows a user to adjust the height adjust mechanism 302. In addition, a user can adjust the speed of the motor, torque, and other various parameters associated with the control and location of the height adjust mechanism 304, via the position element.

Additionally or alternatively, a micro-switch 450 can be employed to determine the position of the height adjust mechanism 304. In one embodiment, the micro-switch 450 is located in the pivot of an upright vacuum cleaner wherein the micro-switch 450 provides an output when the handle of the vacuum is located in a particular position. Once such a predetermined position is achieved, the output of the micro-switch 450 can be sent to the sensor processor to change the height of the height adjust mechanism 304 accordingly. In one approach, the height adjust mechanism 304 is raised to a full upright position, thereby lifting a brush, such as brush 54, off the surface of the floor.

The sensor processor 332 can include a memory 452 that receives, stores, and/or organizes data for subsequent retrieval. In one example, the memory 452 stores a value that relates to the position of the height adjust mechanism 304 when a first event (e.g., power down of the vacuum, handle of the vacuum in upright position) occurs. When a second event occurs (e.g., power up after power down, handle in an extended position, etc.), the height setting of the height adjust mechanism 304 can be retrieved from the memory and employed to drive the height adjust mechanism 304 to the height associated with the first event.

In order to provide feedback control of the position of the height adjust mechanism 304, an encoder 440 can communicate data received from the height adjust motor 302 to the nozzle height motor controller 300. In one example, the encoder 440 is a 1K potentiometer connected to the output shaft of the gear box (not shown) of the height adjust motor 302. The potentiometer can provide a value which is directly proportional to the height setting of the height adjust mechanism 304. In one approach, the output of the potentiometer is communicated to an analog-to-digital converter (not shown) to provide data to the height adjust mechanism height motor controller 300 regarding the height setting. It is to be appreciated that the encoder can be substantially any electro-mechanical device that provides a linear output proportional to location.

A height level indicator 442 can receive data from the encoder 440 and/or sensor processor 332 and display the corresponding height of the height adjust mechanism 304. The height level indicator 442 can be located in substantially any conspicuous location on the vacuum cleaner so that a user can view the height adjust mechanism height while using the vacuum cleaner. The height level indicator 442 can be updated periodically, based on event, each time the vacuum is powered on, etc.

With reference to FIG. 21, an upright bagless vacuum cleaner 470 includes an upright housing section 472 and a nozzle base section 474. The sections 472 and 474 are pivotally or hingedly connected through the use of trunnions or another suitable hinge assembly so that the upright housing section 472 pivots between a generally vertical storage position (as shown) and an inclined use position. The upright section 472 includes a handle 476 extending upward therefrom, by which an operator of the vacuum cleaner 470 is able to grasp and maneuver the vacuum cleaner 470.

During vacuuming operations, the nozzle base 474 travels across a floor, carpet, or other subjacent surface being cleaned. An underside of the nozzle base includes a main suction opening formed therein, which can extend substantially across the width of the height adjust mechanism at the front end thereof. The main suction opening is in fluid communication with the vacuum upright body section 472 through a passage and a connector hose assembly. A plurality of wheels 478 support the nozzle base on the surface being cleaned and facilitate its movement.

As is well known, the upright vacuum cleaner 470 includes a vacuum or suction source 480 for generating the required suction airflow for cleaning operations. A suitable suction source, such as an electric motor and fan assembly, generates a suction force in a suction inlet and an exhaust force in an exhaust outlet. Optionally, a filter assembly can be provided for filtering the exhaust air stream of any contaminants which may have been picked up in the motor assembly immediately prior to its discharge into the atmosphere. The motor assembly suction inlet, on the other hand, is in fluid communication with a dust and dirt separating region of the vacuum cleaner 470 to generate a suction force therein.

The dust and dirt separating region housed in the upright section 472 includes a dirt cup or container 482 which is releasably connected to the upper housing 472 of the vacuum cleaner 470. Cyclonic action in the dust and dirt separating region removes a substantial portion of the entrained dust and dirt from the suction airstream and causes the dust and dirt to be deposited in the dirt container 482. The suction airstream enters an air manifold 484 of the dirt container through a suction airstream inlet section which is formed in the air manifold. The suction airstream inlet is in fluid communication with a suction airstream hose through a fitting, for example. The dirt container 482 can be mounted to the vacuum cleaner upright section 472 via conventional means.

The dirt container 482 includes first and second generally cylindrical sections 486 and 488. Each cylindrical sections includes a longitudinal axis, the longitudinal axis of the first cylindrical section 486 is spaced from the longitudinal axis of the second cylindrical section 488. The first and second cylindrical sections 486 and 488 define a first cyclonic airflow chamber and a second cyclonic airflow chamber, respectively. The first and second airflow chambers are each approximately vertically oriented and are arranged in a parallel relationship. The cylindrical sections 486 and 488 have a common outer wall and are separated from each other by a dividing wall. The first and second cyclonic airflow chambers include respective first and second cyclone assemblies. The first and second cyclone assemblies act simultaneously to remove coarse dust from the airstream. The air manifold 484 collects a flow of cleaned air from both of the airflow chambers and merges the flow of cleaned air into a single cleaned air outlet passage or conduit 490, which is in fluid communication with an inlet of the electric motor and fan assembly. The outlet passage 490 has a longitudinal axis which is oriented approximately parallel to the longitudinal axes of the first and second cyclonic chambers.

The conduit 49 can be secured to the nozzle base 474. The sensor 444 can be used to control the operation of a motor (not visible) that powers a brushroll (not visible) mounted in the nozzle base. Also, the sensor 444 can be used to control the operation of the suction source 480, i.e., the amount of suction being drawn, depending on the type of floor surface being cleaned. For example, less suction may be employed on a bare floor and more suction used on a carpeted floor. Also, the brushroll can be powered only when the nozzle base is on a carpeted floor. When a bare floor is encountered, the motor powering the brushroll can be shut off. Moreover, the wheels 478 can be selectively powered by a drive motor (not shown) to propel the vacuum cleaner 400 over a surface. The output of the sensor 444 can be used, if desired, to control the operation of the drive motor.

Figure 22:
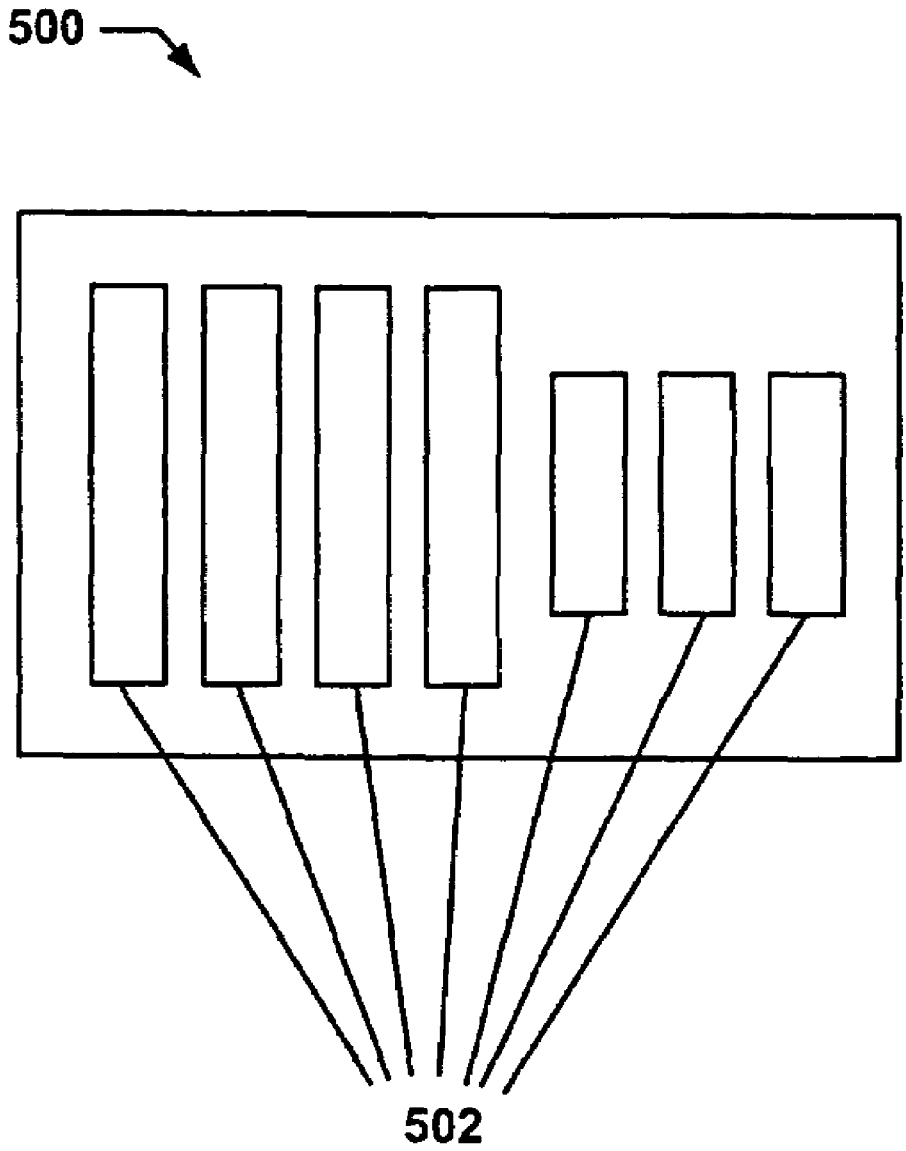
FIG. 22 is a schematic view of an exemplary height level indicator according to one aspect of the present invention.

As illustrated in FIG. 22, a height level indicator 442 can be comprised of a hardware device 500 that contains a plurality of LED bars 502 that display respective height adjust mechanism 304 height levels. In one example, the lowest height level is indicated by illuminating a single (e.g., right most) LED bar. In another example, the highest height level is indicated by illuminating all of the LED light bars. In this manner, a user can monitor the nozzle height of the vacuum cleaner during use. The height level indicator 442 can be mounted on the handle 476 of the vacuum cleaner 470 or in another suitable location.

Figure 23:
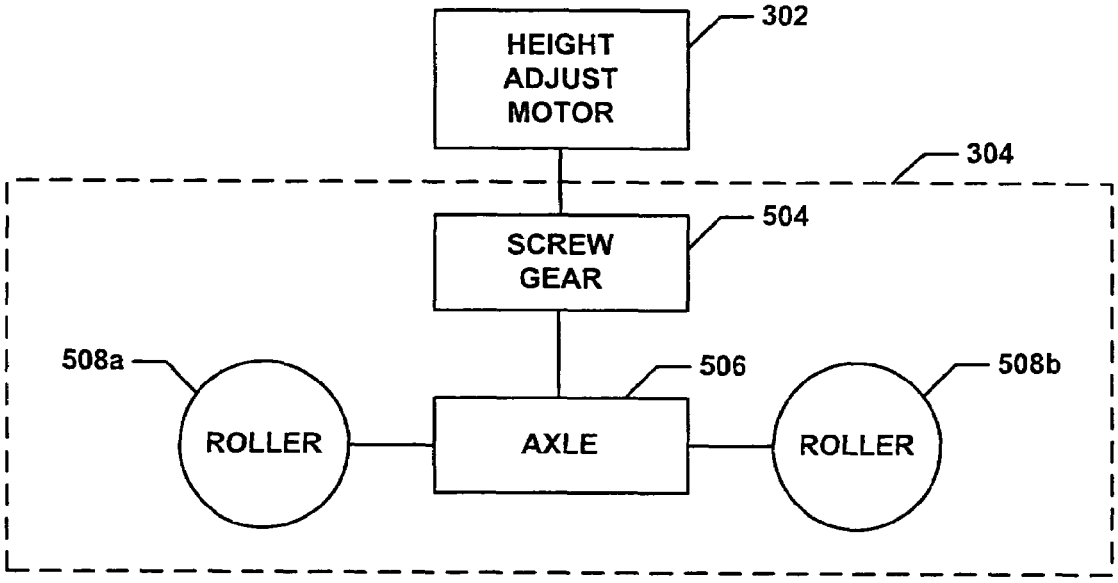
FIG. 23 is a schematic view of an exemplary height adjust mechanism according to one aspect of the present invention.

It should be appreciated that the height adjust mechanism 304 disclosed herein can be employed on the vacuum cleaner 470. As is well known, there are a plethora of height adjust mechanisms known in the art. U.S. Pat. Nos. 5,269,042 and 5,042,109 are two examples of such. In one embodiment, as illustrated in FIG. 23, the height adjustment mechanism 304 can include a screw gear 504, an axle 506 and rollers 508*a* and 508*b*. The height adjust motor 302 is mechanically coupled to and drives the screw gear 504. The screw gear 504 raises or lowers the nozzle base (not shown) relative to the axle 506 based upon the speed and direction of the height adjust motor 302. The rollers 508*a* and 508*b* are mechanically coupled to the axle 506 and can move freely utilizing bearings or other similar structures. Of course a variety of other known mechanisms can be employed.

Figure 24:
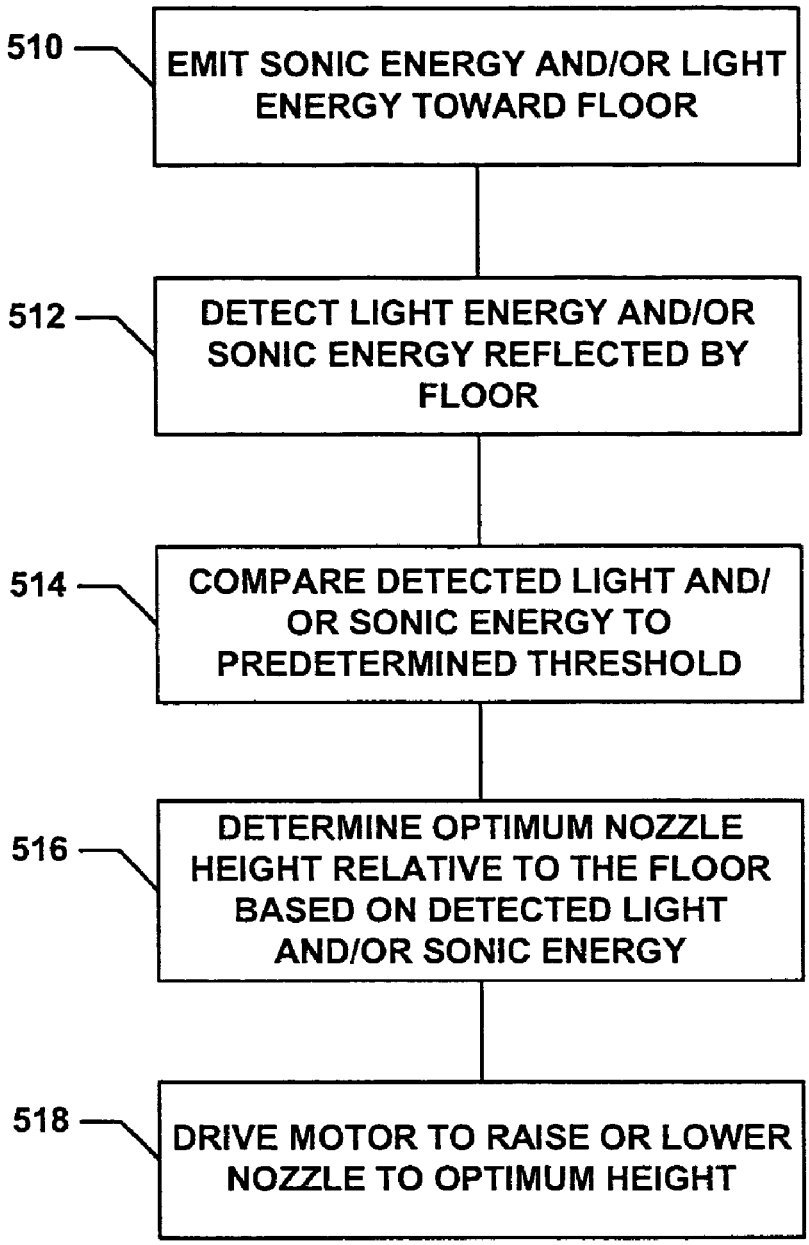
FIG. 24 is a flowchart of a methodology that drives a motor to locate a height adjust motor to an appropriate height according to one aspect of the present invention.
Figure 25:
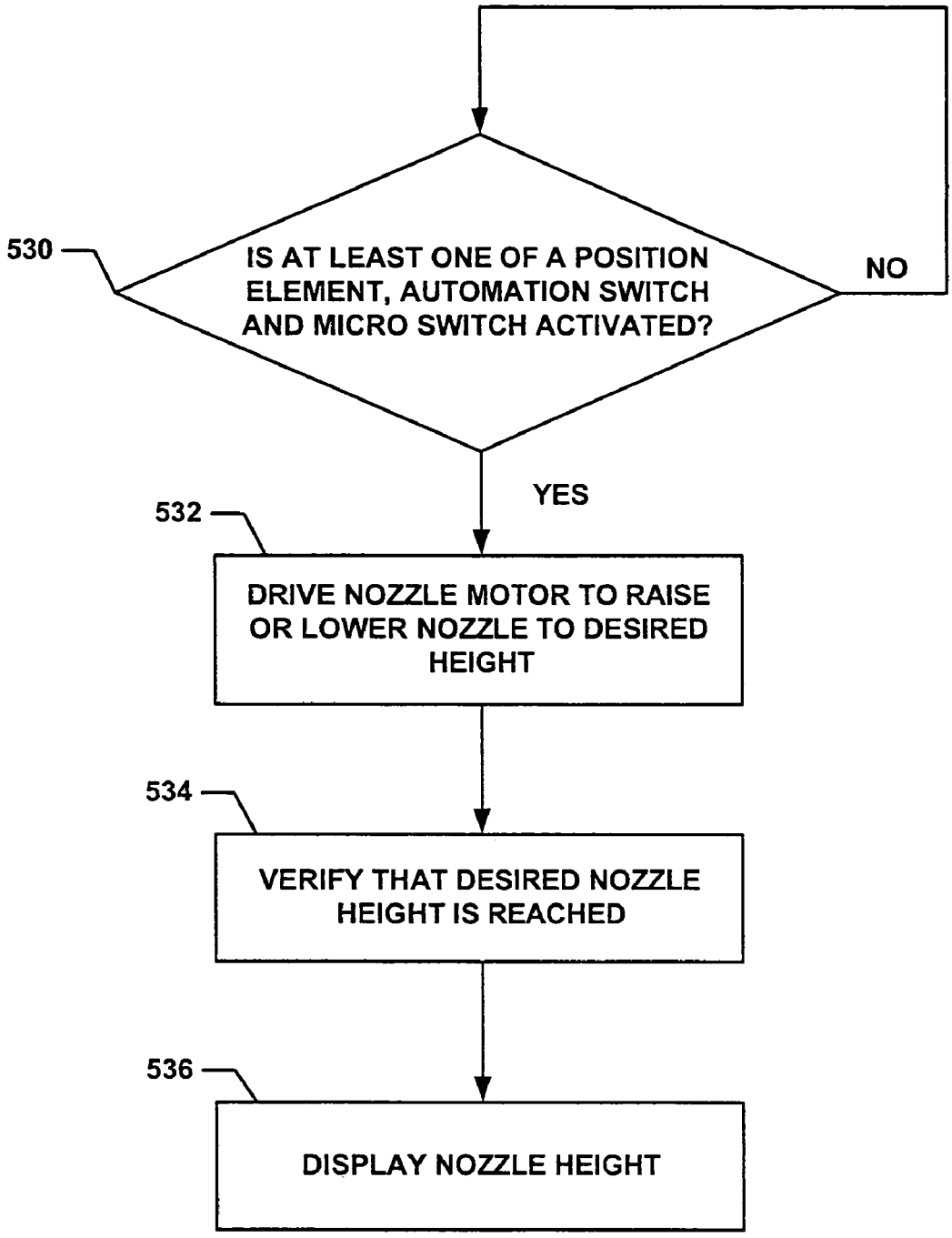
FIG. 25 is a flowchart of a methodology that displays a height adjust mechanism height according to one aspect of the present invention.
Figure 26:
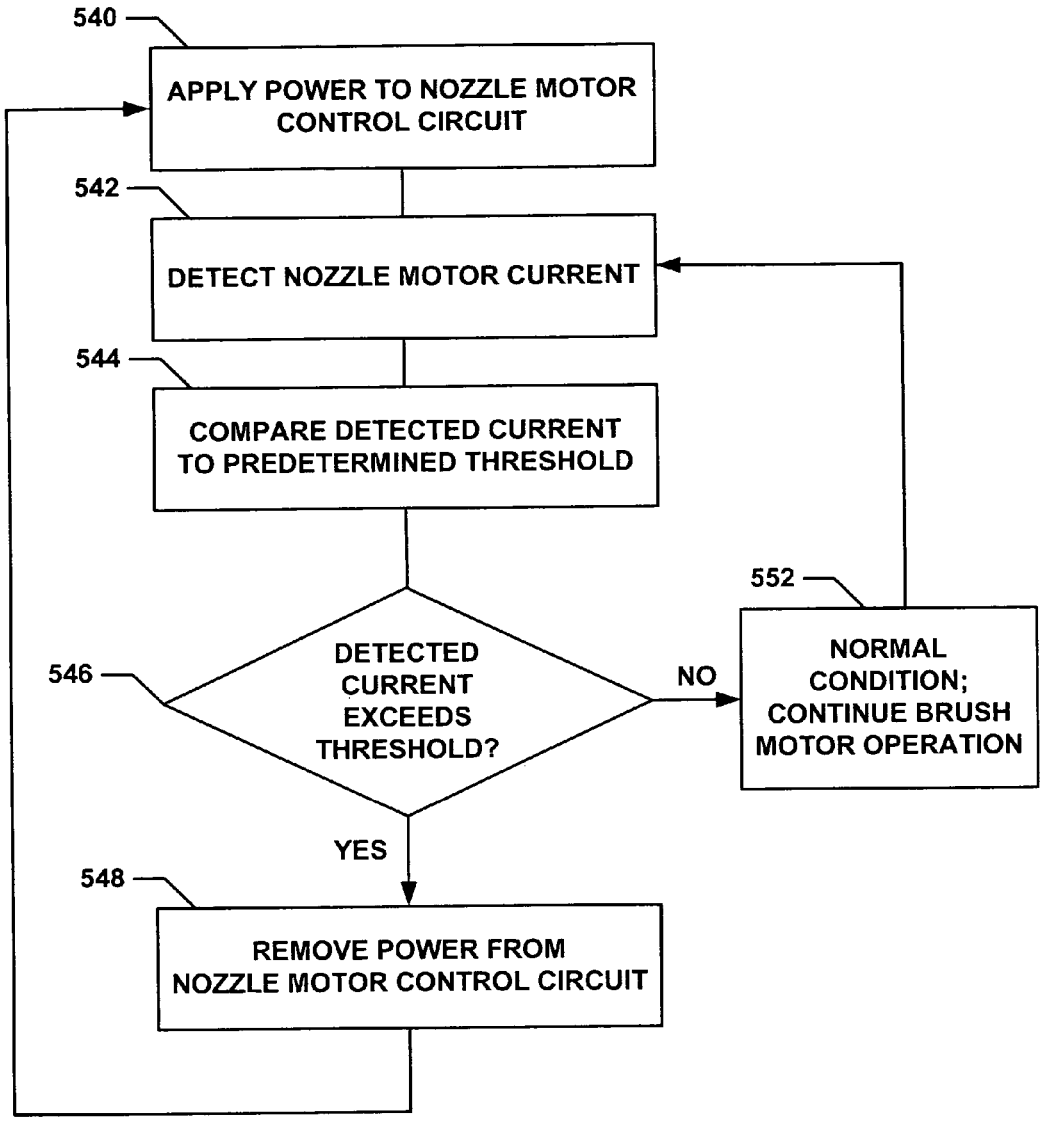
FIG. 26 is a flowchart of a methodology that removes power from a height adjust motor control circuit according to one aspect of the present invention.

While, for purposes of simplicity of explanation, the methodologies of FIGS. 24-26 are shown and described as executing serially, it is to be understood and appreciated that the present invention is not limited by the illustrated order, as some aspects could, in accordance with the present invention, occur in different orders and/or concurrently with other aspects from that shown and described herein. Moreover, not all illustrated features may be required to implement a methodology in accordance with an aspect the present invention.

Referring now to FIG. 24, which illustrates a methodology to drive the vacuum cleaner height adjust mechanism to an optimum height relative to the floor. At reference numeral 510, sonic energy and/or light energy is emitted toward the floor. In one approach, such sonic energy and/or light energy can be emitted from a sensor designed to utilize one or more non-contact measurement techniques. At 512, the light energy and/or sonic energy reflected by the floor is detected. In one approach, such reflected signals can be received by one or more optical or sonic elements such as a CCD array, lens, microphone, or other energy receiving means. In addition, the light and/or sonic energy can be converted (e.g., via an analog-to-digital converter, etc.) to one or more electrical signals for further processing.

At 514, the received light and/or sonic energy is compared to one or more predetermined thresholds. Such predetermined thresholds can be established based on a particular physical quantification and/or measurement and stored in one or more look up tables for subsequent retrieval. In one aspect, a set of predetermined thresholds relate to various floor types, such as concrete, laminate, ceramic, wood, sculptured carpet, low pile carpet, cut pile carpet, and high pile carpet. Another set of thresholds can relate to distance as it correlates to various features of a particular model of vacuum cleaner. For example, the base of one vacuum may have a lower clearance than another vacuum and thus, respond differently to various changes in floor distance.

At 516, suitable nozzle height is determined relative to the floor, based at least in part on the detected light and sonic energy. In one aspect, the height adjust mechanism height can be related to area of coverage. In another aspect, the nozzle height can relate to strength of vacuum without regard to area covered by the nozzle. For instance, strong vacuum suction within a limited area may be required for a high pile carpet, whereas low suction and broader vacuum area is desired for a hardwood floor. Thus, once the floor type and distance are determined from the previous steps, the nozzle height can be determined. At 518, the height adjust mechanism is raised or lowered to a particular height via a motor.

FIG. 25 illustrates a methodology to continuously display the vacuum cleaner nozzle height. At reference numeral 530, a determination is made as to whether at least one of a position element, automation switch and micro-switch is activated. If none of these are activated, monitoring continues until one of the foregoing is activated. After at least one of the position element, the automation switch and the micro-switch are activated, a motor is driven to raise or lower a nozzle to a desired height. As noted above, desired height can be determined based on one or more factors such as floor type, floor distance, vacuum model, drive motor speed, suction motor speed, brush motor speed, etc.

At 534, verification is performed to ensure that the desired nozzle height is reached. In one aspect, such verification can be performed utilizing an encoder, such as a linear potentiometer, for example. In another aspect, a non-contact laser displacement sensor can measure the nozzle height, relative to a desired surface. Such measurement can be communicated to one or more control elements for further processing. At 536, the nozzle height is displayed. In one approach, information from the verification means can be indicated via a display such as a computer monitor, one or more LED arrays, lamps, dials, etc. It is to be appreciated that substantially any device that can receive and display data is contemplated.

FIG. 26 illustrates a methodology to provide height adjust motor current sensing and control for a vacuum cleaner. At 540, power is applied to a height adjust motor control circuit associated with the vacuum cleaner. At 542, a height adjust motor overcurrent feedback signal is monitored by a sensor processor via a height adjust motor overcurrent sensor. The feedback signal, for example, may provide information associated with height adjust motor RPM, height adjust motor torque, quantity of height adjust motor revolutions, and/or distance of height adjust motor rotation. Next, at step 544, the feedback signal is compared to a predetermined threshold.

At step 546, it is determined whether or not the feedback signal is less than the predetermined threshold. At 548, if the detected current is more than the threshold, an overcurrent condition exists and the nozzle height adjust motor is disabled. Power can be removed from the height adjust motor control circuit by some form of manual reset. For example, removing and re-applying power to power and control components associated with the height adjust motor would suffice as a reset. After the manual reset, the process starts over when power is applied to the height adjust motor control circuit in step 540.

If the feedback signal is less than the predetermined threshold in step 546, a normal condition exists and the process advances to step 552. At step 552, height adjust motor operation continues and the process returns to step 542. Steps 542-548 are periodically repeated while power is applied to the height adjust motor. The predetermined threshold may provide overcurrent protection for short circuit conditions and/or overload conditions of the height adjust motor, including locked rotor conditions.

While the invention is described herein in conjunction with several exemplary embodiments, it is evident that many alternatives, modifications, and variations will be apparent to those skilled in the art. Accordingly, the embodiments of the invention in the preceding description are intended to be illustrative, rather than limiting, of the spirit and scope of the invention. More specifically, it is intended that the invention embrace all alternatives, modifications, and variations of the exemplary embodiments described herein that fall within the spirit and scope of the appended claims or the equivalents thereof.

What is claimed is:

1. A vacuum cleaner, including:

a housing;

a height adjust mechanism disposed on the housing;

a height adjust motor, disposed within said housing, that controls a height of the height adjust mechanism;

a position element mounted to said housing that allows a user to select a particular height for the height adjust mechanism;

a floor distance sensor, disposed within said housing that emits light energy toward a floor surface and detects light energy reflected by the floor surface;

a sensor processor, mounted to said housing, in communication with the position element and the floor distance sensor to provide a signal that relates to a position of the height adjust mechanism based at least in part upon data received from the position element or by comparing the light energy detected by a floor distance sensor to a predetermined threshold;

a controller processor, mounted to said housing, in communication with the sensor processor for selectively controlling a height of the height adjust mechanism relative to the floor surface on which the vacuum cleaner is positioned based at least in part upon data received from the position element or the floor distance sensor;

a height adjust motor controller, in communication with the controller processor, that drives the height adjust motor to locate the height adjust mechanism in an appropriate position relative to the subjacent surface; and an encoder coupled to the height adjust motor that provides the location of the height adjust mechanism to the height adjust motor controller.

2. The vacuum cleaner as set forth in claim 1 wherein the vacuum cleaner is a type selected from the group consisting of a robotic vacuum cleaner, a robotic canister-like vacuum cleaner, a hand vacuum cleaner, a carpet extractor, a canister vacuum cleaner, a stick vacuum cleaner, an upright vacuum cleaner, and a shop-type vacuum cleaner.

3. The vacuum cleaner as set forth in claim 1, further including:

a height level indicator that visually indicates the height of the height adjust mechanism based at least in part upon data received from at least one of the sensor processor and the encoder.

4. The vacuum cleaner as set forth in claim 1, the vacuum cleaner further including:

an overcurrent sensor, disposed within said housing, in communication with the sensor processor and the height adjust motor for monitoring a characteristic of the height adjust motor and providing an associated feedback signal to the sensor processor; and a reset switch, disposed within said housing, in operative communication with the sensor processor and the height adjust motor controller for manually resetting power applied to the height adjust motor and providing a reset switch activation signal to the sensor processor;

wherein the sensor processor compares the feedback signal to a predetermined threshold and, removes power from the height adjust motor and disables operation of the height adjust mechanism when the feedback signal is less than the predetermined threshold, until power is reset.

5. The vacuum cleaner as set forth in claim 4, the overcurrent sensor including:

an overcurrent feedback module in operative communication with the sensor processor and the height adjust motor for monitoring the height adjust motor characteristic and providing the feedback signal to the sensor processor.

6. The vacuum cleaner as set forth in claim 5, the overcurrent sensor including:

an electronic switch in operative communication with the sensor processor and the height adjust motor for enabling and disabling operation of the height adjust motor; and a current sense circuit in operative communication with the sensor processor and the height adjust motor for sensing the level of electrical current flowing through the height adjust motor.

7. The vacuum cleaner as set forth in claim 4 wherein the height adjust motor characteristic is an electrical signal associated with the feedback signal includes one or more of a height adjust motor RPM, a height adjust motor torque, a quantity of height adjust motor revolutions, and a distance of height adjust motor rotation.

8. The vacuum cleaner as set forth in claim 1, the vacuum cleaner further including:

a floor type sensor, disposed within said housing, in operative communication with the sensor processor for emitting sonic energy toward a floor being traversed by the vacuum cleaner and detecting sonic energy reflected by the floor;

wherein the sensor processor compares the detected sonic energy to a plurality of values in a lookup table (LUT), wherein the LUT values represent a plurality of types of floors, matching the detected sonic energy to a LUT value to determine the type of floor being traversed, and varying the height of the height adjust mechanism based at least in part on the type of floor being traversed.

9. The vacuum cleaner as set forth in claim 8, the vacuum cleaner further including:

a signal generator circuit, disposed within said housing, in communication with the sensor processor and the floor type sensor for generating a signal associated with the sonic energy emitted by the floor type sensor;

a signal conditioning circuit, disposed within said housing, in communication with the floor type sensor for conditioning a signal associated with the sonic energy detected by the floor type sensor; and a comparator processor, disposed within said housing, in communication with the signal conditioning circuit and the sensor processor for comparing the conditioned signal to the LUT values.

10. The vacuum cleaner as set forth in claim 9, the vacuum cleaner further including:

a signal conditioning circuit, disposed within said housing, in communication with the floor distance sensor and the sensor processor for conditioning a signal associated with the light energy detected by the floor distance type sensor.

11. The vacuum cleaner as set forth in claim 1, further including:

a processing component that receives data from at least one of the floor type sensor and the floor distance sensor and determines an appropriate height for the height adjust mechanism.

12. The vacuum cleaner as set forth in claim 1, further including:

a micro-switch mechanically coupled to the vacuum housing that communicates a signal to the sensor processing when activated to determine the height of the height adjust mechanism.

13. A vacuum cleaner, comprising:

a height adjust mechanism base including a suction inlet;

an upright housing pivotally mounted on said height adjust mechanism base;

a suction source disposed in one of said height adjust mechanism base and said housing, said suction source being in fluid communication with said suction inlet;

a floor sensor mounted to one of said height adjust mechanism base and said housing;

a sensor processor, mounted to one of said height adjust mechanism base and said housing, communicating with said floor sensor to provide a signal that relates to a position of said suction inlet in relation to a subjacent surface on which the vacuum cleaner is located;

a height adjust mechanism mounted to said height adjust mechanism base, said sensor processor communicating with said mechanism, wherein an output of said sensor processor controls an operation thereof;

a manual control located on one of said height adjust mechanism base and said housing for overriding said sensor processor and manually activating said mechanism;

an overcurrent sensor, disposed within said housing, in communication with the sensor processor and the height adjust motor to monitor a current of the height adjust motor, compare the current to a predetermined threshold and provide an associated feedback signal to the sensor processor; and a floor type sensor, disposed within said housing, in operative communication with the sensor processor for emitting sonic energy toward a floor being traversed by the vacuum cleaner and detecting sonic energy reflected by the floor;

wherein the sensor processor compares the detected sonic energy to a plurality of values in a lookup table (LUT), wherein the LUT values represent a plurality of types of floors, matching the detected sonic energy to a LUT value to determine the type of floor being traversed, and varying the height of the height adjust mechanism based at least in part on the type of floor being traversed.

14. The vacuum cleaner of claim 13, wherein said floor sensor comprises at least one of a sonic sensor and a light sensor.

15. The vacuum cleaner of claim 13, further comprising:

a controller processor, mounted to one of said height adjust mechanism base and said housing, communicating with said sensor processor and said height adjust mechanism height adjustment mechanism for controlling the operation of said mechanism.

16. The vacuum cleaner of claim 13, further comprising:

a floor distance sensor, disposed within said housing, in operative communication with the sensor processor for emitting light energy toward a surface of a floor toward which the vacuum cleaner is advancing and detecting light energy reflected by the floor, wherein the sensor processor compares the detected light energy to a predetermined threshold and, locates the height adjust mechanism based at least in part upon the detected light energy.

17. The vacuum cleaner of claim 13, further comprising:

a floor type sensor, disposed within said housing, in operative communication with the sensor processor for emitting sonic energy toward a floor being traversed by the vacuum cleaner and detecting sonic energy reflected by the floor;

wherein the sensor processor compares the detected sonic energy to a plurality of values in a lookup table (LUT), wherein the LUT values represent a plurality of types of floors, matching the detected sonic energy to a LUT value to determine the type of floor being traversed, and varying the height of the height adjust mechanism based at least in part on the type of floor being traversed.

* * * * *

UNITED STATES PATENT AND TRADEMARK OFFICE

CERTIFICATE OF CORRECTION

PATENT NO. : 7,599,758 B2
APPLICATION NO. : 11/294591
DATED : October 6, 2009
INVENTOR(S) : Reindle et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 936 days.

Signed and Sealed this

Twenty-eighth Day of September, 2010

David J. Kappos

David J. Kappos
*Director of the United States Patent and Trademark Office*